US012180801B2

(12) United States Patent
Gimbel et al.

(10) Patent No.: US 12,180,801 B2
(45) Date of Patent: Dec. 31, 2024

(54) METHOD AND TOOL FOR DIRECTING AN ANNULAR FLOW ACROSS A WELL BORE INTERVAL

(71) Applicant: Basin Energy Solutions IP Holdings Corporation, Golden, CO (US)

(72) Inventors: Dean Alan Gimbel, Thornton, CO (US); Matthew J. Ward, Golden, CO (US); Christopher Clark, Golden, CO (US); Michael A. Gimbel, Alhambra, CA (US)

(73) Assignee: Basin Energy Solutions IP Holdings Corporation, Golden, CO (US)

( * ) Notice: Subject to any disclaimer, the term of this patent is extended or adjusted under 35 U.S.C. 154(b) by 0 days.

(21) Appl. No.: 18/674,979

(22) Filed: May 27, 2024

(65) Prior Publication Data

US 2024/0392648 A1 Nov. 28, 2024

Related U.S. Application Data

(60) Provisional application No. 63/469,385, filed on May 27, 2023.

(51) Int. Cl.
*E21B 33/128* (2006.01)
*E21B 34/10* (2006.01)
(Continued)

(52) U.S. Cl.
CPC ..... *E21B 33/1285* (2013.01); *E21B 34/10* (2013.01); *E21B 43/261* (2013.01); *E21B 43/267* (2013.01)

(58) Field of Classification Search
CPC ..... E21B 33/1285; E21B 34/10
See application file for complete search history.

(56) References Cited

U.S. PATENT DOCUMENTS 2,874,785 A * 2/1959 Muse ..... E21B 21/10 137/504
5,163,515 A 11/1992 Tailby et al.
(Continued)

FOREIGN PATENT DOCUMENTS

| | | |
|---|---|---|
| CN | 207470166 U | 6/2018 |
| GB | 2 377 721 A | 1/2003 |
| WO | 2014/158337 A1 | 10/2014 |

OTHER PUBLICATIONS

International Search Report and Written Opinion for Int. Appl. No. PCT/US2024/031192, mailed Sep. 26, 2024, 13 pp.

*Primary Examiner* — Matthew R Buck
(74) *Attorney, Agent, or Firm* — James A. Sheridan; Sheridan Law, LLC

(57) ABSTRACT

There is disclosed a method for treating an isolated hydrocarbon interval feedable through a production tubing inside a well bore and forming an annulus therebetween. A perforated cylindrical tool having an expandable annular seal may attach to the production tubing and house a slidable element positionally responsive to an injection velocity of a well fluid. The tool may be lowered to a sealing depth for bracketing the hydrocarbon interval. Injection of the well fluid may drag a narrowing bore of the slidable element downward for expanding the annular seal against the well bore. The well fluid may also be directed from the element bore to the annulus by aligning an element flow port with a corresponding tool passage, a downstream or an upstream flow being selectable by an injection velocity for slidably aligning the corresponding flow ports having different axial locations.

17 Claims, 29 Drawing Sheets

(51) Int. Cl.
*E21B 43/26* (2006.01)
*E21B 43/267* (2006.01)

(56) References Cited

U.S. PATENT DOCUMENTS

| | | | | |
|---|---|---|---|---|
| 6,364,017 | B1 | 4/2002 | Stout et al. | |
| 6,394,184 | B2 | 5/2002 | Tolman et al. | |
| 6,488,082 | B2 | 12/2002 | Echols et al. | |
| RE38,636 | E | 10/2004 | Gondouin | |
| 7,185,703 | B2 | 3/2007 | Jannise et al. | |
| 7,243,723 | B2 | 7/2007 | Surjaatmadja et al. | |
| 7,296,462 | B2 | 11/2007 | Gregory et al. | |
| 2005/0241835 | A1 | 11/2005 | Burris, II et al. | |
| 2010/0051278 | A1 | 3/2010 | Mytopher et al. | |
| 2012/0261127 | A1* | 10/2012 | Zhou | E21B 21/103 166/118 |
| 2013/0344448 | A1 | 12/2013 | Tilmont et al. | |
| 2014/0262263 | A1 | 9/2014 | Yudin et al. | |
| 2014/0345949 | A1 | 11/2014 | Cramer et al. | |
| 2015/0308250 | A1* | 10/2015 | Anders | E21B 43/164 166/308.1 |
| 2017/0145784 | A1* | 5/2017 | Zhou | E21B 33/128 |
| 2020/0003038 | A1 | 1/2020 | Anders | |
| 2023/0003095 | A1 | 1/2023 | Morgan | |

* cited by examiner

Horizontal Well Completion

METHOD AND TOOL FOR DIRECTING AN ANNULAR FLOW ACROSS A WELL BORE INTERVAL

REFERENCE TO PENDING PRIOR PATENT APPLICATION

This application claims the benefit under 35 U.S.C. 119 (e) of U.S. Provisional Patent Application No. 63/469,385, filed May 27, 2023 by Dean Alan Gimbel for "METHOD AND TOOL FOR DIRECTING AN ANNULAR FLOW ACROSS A WELL BORE INTERVAL," which patent application is hereby incorporated herein by reference.

BACKGROUND

A well bore may be subdivided into multiple intervals of permeable rock formation through which a desired fluid or gas flow may be produced. Prior to production, a cluster of perforations may be created in a well casing lining the well bore and within each of the intervals. In an oil or gas well, many adjacent intervals may be economically fractured or restimulated simultaneously by injecting well fluids downstream using water, lubricants, acid, and/or proppants such as sand. However, production may be anemic when some hydrocarbon intervals take in more of the injected fluids than others, leaving some formations unfractured.

In one technique, a straddle packer may demarcate the target interval with inflatable bladders or compressible seals that seal an annulus around a production tubing feeding the target interval. Well fluids then may be injected. Unfortunately, the packers must be released and moved for each interval needing stimulation, costing time and wearing out the seals. Eventually, the plugs may need to be drilled out to make way for the production tubing.

Also, sustained injection of the proppant (e.g. sand) may form dunes at a formation face of the interval in a way that causes a surge in well pressure or a screen out. An immediate shut down of fluid injection may then be necessary, hoping that natural flowback corrects the clogging. In order to avoid costly screen outs, a more conservative use of proppant is employed, which also reduces well production.

In certain stages of well completion, washes of acid or surfactants may be injected in order to 'wet' each of the intervals or to clean perforations in the well casing of paraffin or debris, thereby increasing a flow of hydrocarbons. But upstream back surfaces of the targeted intervals or perforations may not be washed because there is no controlled back flushing. Although plugs may be inserted sequentially, starting deep in the well and backing upwards, the plugs must be eventually drilled out to make way for the production tubing, thereby increasing the costs of well completion.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an embodiment, there is disclosed an isolating tool for selectively orienting the flow of a well fluid with respect to a demarcation in an annulus of a well bore. The annulus may be defined by a production tubing inside the well bore. The tool may attach to a lower end of the production tubing injecting or receiving the well fluid. The tool may include a cylindrical tool housing having a top end conductively connectable to the production tubing and a bottom end opposite the top end. A lower cylindrical element may be spring-positioned within and may slidably seal its element exterior against an interior wall of the tool housing. The element may include an element bore narrowing toward one end and conductive of the well fluid from the production tubing.

The spring-positioning and narrowing bore may be configured to compress the element toward the narrowing end of the element in proportion to an injection velocity of the well fluid. A lower expandable annular seal may be disposed on an exterior wall of the tool housing for restricting annular fluid flow across the demarcation. A lower compression means may link the slidable element to the lower seal for expanding the seal against the well bore when the injection velocity of the well fluid exceeds a lower seal threshold. Exceeding the lower seal threshold may enable a treatment of a hydrocarbon production interval surrounding the well bore above the demarcation.

In another embodiment, there is disclosed an isolating tool for selectively orienting the flow of a well fluid with respect to two demarcations bracketing a fracture zone of a well bore. The tool may attach to a lower end of a production tubing injecting or receiving the well fluid. The production tubing inside the well bore may define an annulus. The tool may comprise a cylindrical tool housing having a top end conductively connectable to the production tubing and a bottom end opposite the top end. A lower and an upper cylindrical element may be slidingly positioned within and near opposite ends of the tool housing, where each of the elements is spring-positioned. An element exterior may be configured to seal against an interior wall of the tool housing.

Each element may further include an element bore narrowing toward one end and conductive of the well fluid from the production tubing. Each element may be configured to compress the element toward the narrowing end in proportion to an injection velocity of the well fluid by adjusting the spring positioning and bore dimensions. A lower and an upper annular seal may be disposed on an exterior wall of the tool housing at the lower and the upper demarcations, respectively, the seals for restricting fluid flow across the annulus.

A lower and an upper compression means may link the lower and the upper slidable elements, respectively, to the lower and upper seals. The tool may be configured to expand the lower seal against the well bore when the injection velocity exceeds a lower seal threshold. The tool may be configured to expand the upper seal against the well bore when the injection velocity exceeds an upper seal threshold. When an injection velocity exceeds the upper and the lower seal thresholds, the annulus may be sealed at both demarcations for treating the fracture zone.

In a further embodiment, there is disclosed a method for treating an isolated hydrocarbon interval of a well bore feedable by a well fluid through a production tubing inside the well bore. The well bore and the production tubing may form an annulus therebetween. The method may comprise attaching to the production tubing a perforated cylindrical housing disposed with an expandable annular seal. The tool may include an internal element slidable within the housing and mechanically linked to actuate the annular seal. The slidable element may be positionally responsive to an injection velocity of the well fluid and positioned by a spring.

The method may further include lowering the cylindrical housing to a sealing depth for bracketing a perforation cluster in the well bore. The method may further include injecting the well fluid and selecting an injection velocity sufficient to drag the slidable element downward for expanding the annular seal against the well bore. Drag may be induced by an element bore conically narrowing toward a lower end of the element. The method may further include directing an annular flow downstream or upstream of the expandable seal by either setting a downstream injection velocity to slidably align an element downstream port with a corresponding housing perforation, or by setting an upstream injection velocity exclusively different from the downstream injection velocity in order to slidably align an element upstream port with a corresponding housing perforation annular seal.

Additional objects, advantages and novel features of the technology will be set forth in part in the description which follows, and in part will become more apparent to those skilled in the art upon examination of the following, or may be learned from practice of the technology.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified. Illustrative embodiments of the invention are illustrated in the drawings, in which.

DETAILED DESCRIPTION

Embodiments are described more fully below in sufficient detail to enable those skilled in the art to practice the system and method. However, embodiments may be implemented in many different forms and should not be construed as being limited to the embodiments set forth herein. The following detailed description is, therefore, not to be taken in a limiting sense.

When elements are referred to as being "connected" or "coupled," the elements can be directly connected or coupled together or one or more intervening elements may also be present. In contrast, when elements are referred to as being "directly connected" or "directly coupled," there are no intervening elements present.

As may be appreciated, based on the disclosure, there exists a need in the art for a method and tool for well completion that allows an isolation of several production intervals without reconfiguring the tool. Further, there exists a need in the art for selectively directing a flow of the injection fluids above or below an expandable seal in the annulus of a well bore without using mechanical force from a workover rig. Additionally, there exists a need in the art for evenly distributing a flow of injection fluids into or out of the interval during wetting or cleaning operations. Also, there exists a need in the art for an 'on the fly' method of flushing in order to prevent screen outs and create greater propping width in the formation.

Figure 1:
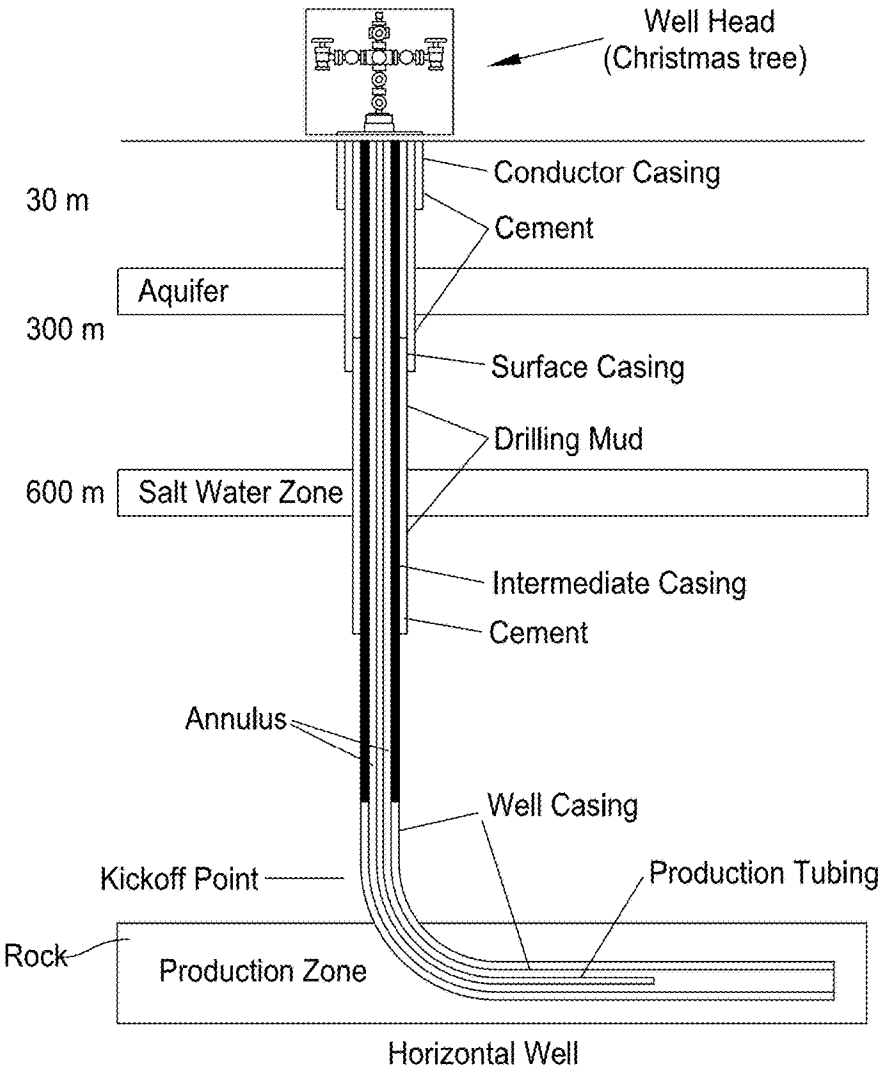
FIG. 1 (PRIOR ART)
FIG. 1 illustrates a horizontal well in the prior art.
Figure 2:
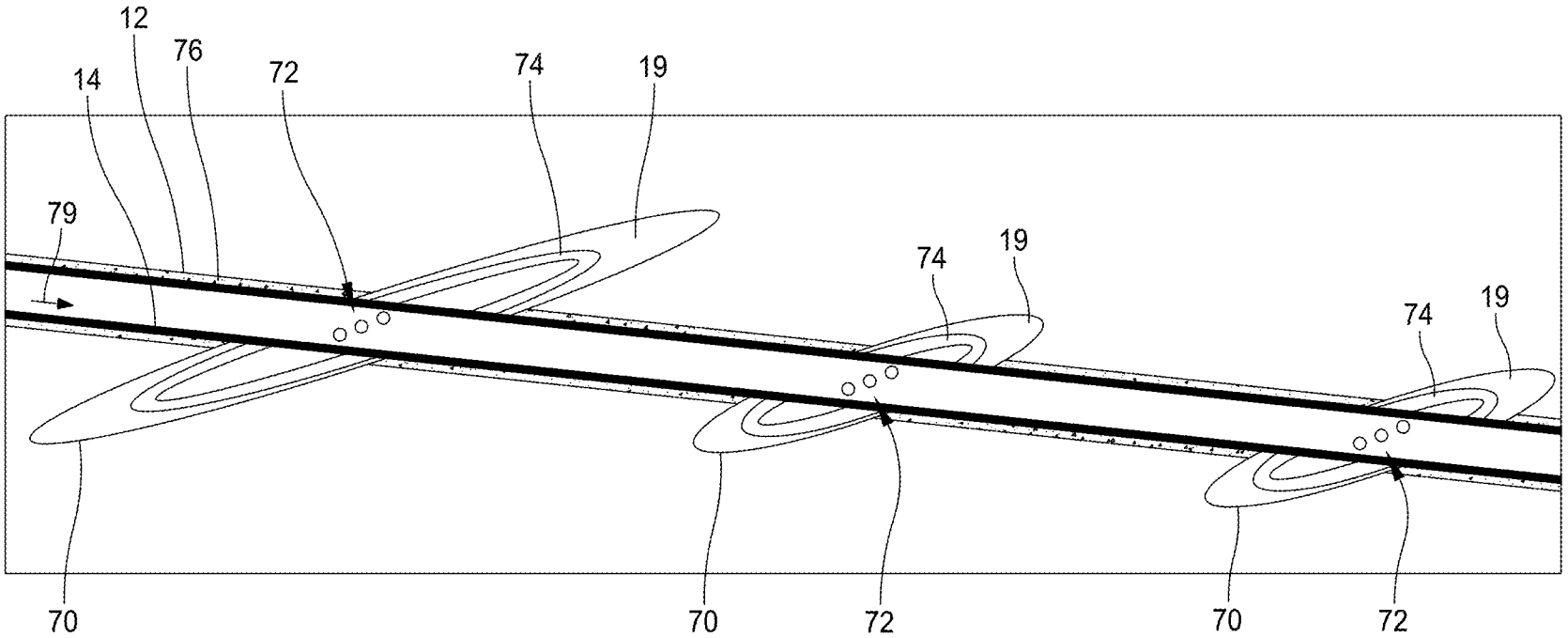
FIG. 2 (PRIOR ART)
FIG. 2 illustrates a hydraulic fracturing of the horizontal well in the prior art.
Figure 3:
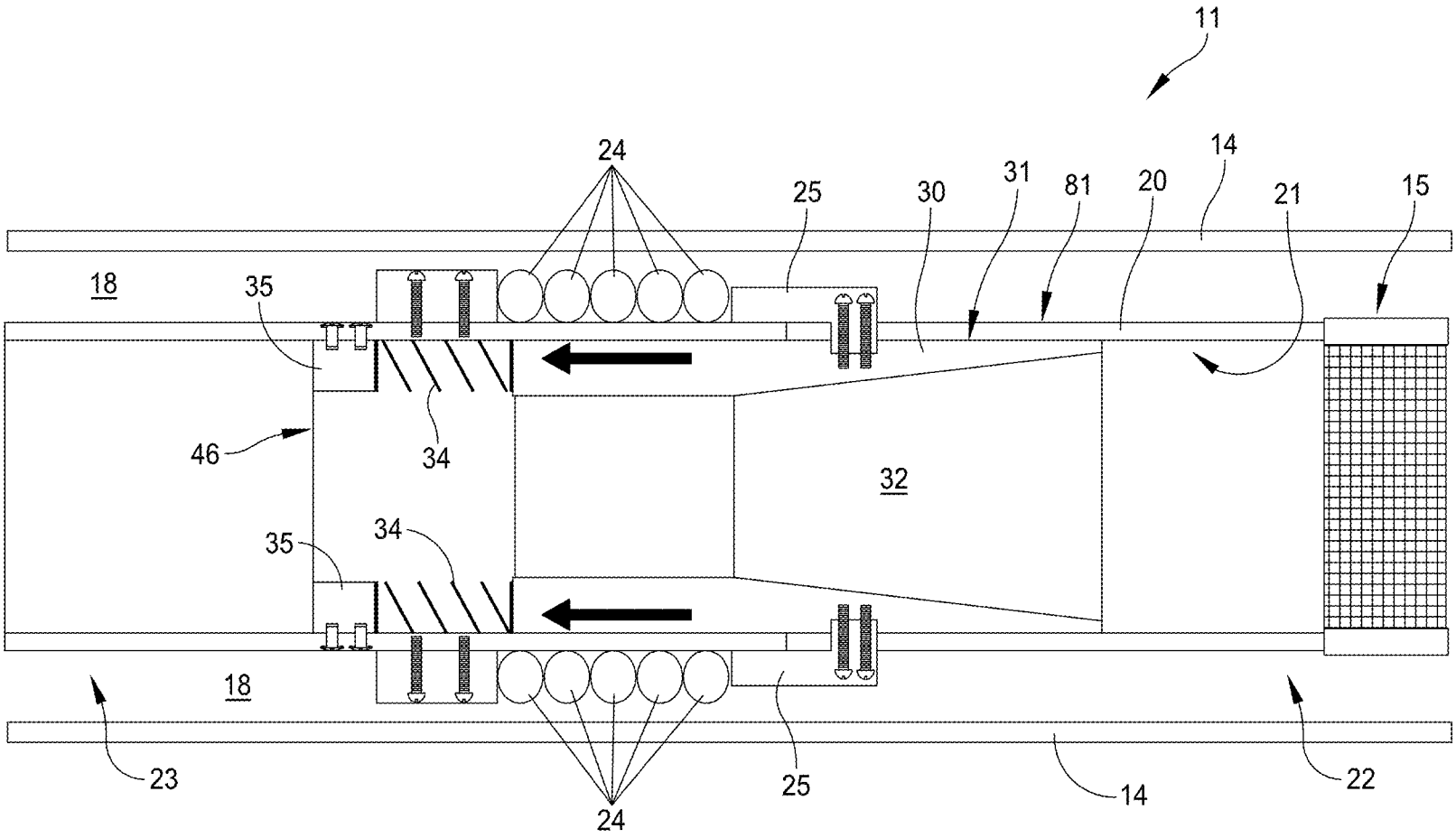
FIG. 3 illustrates a cutaway drawing of an isolating tool with a relaxed annular seal, in accordance with an embodiment of the present disclosure.
Figure 4:
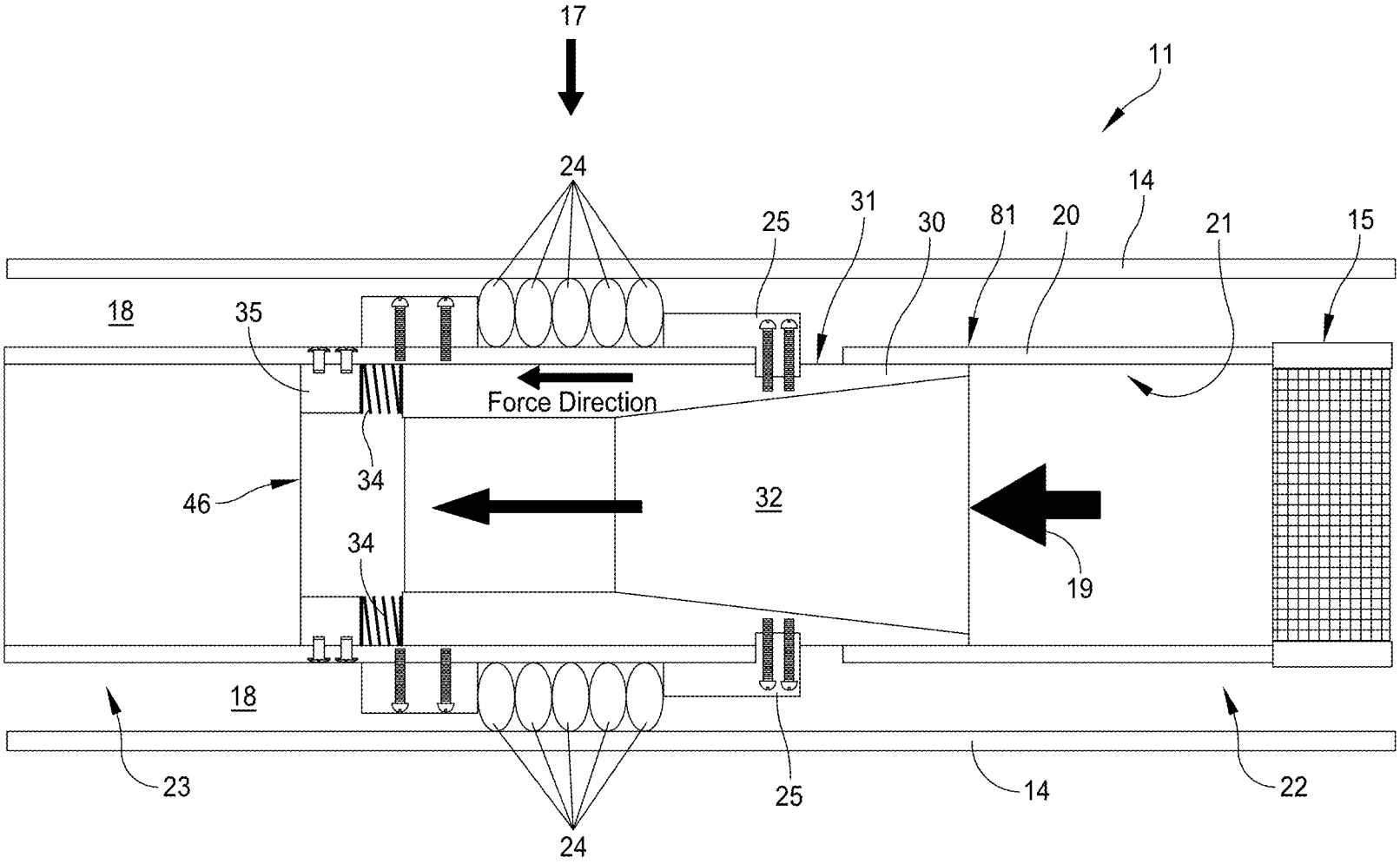
FIG. 4 illustrates a cutaway drawing of an isolating tool with an expanded annular seal, in accordance with an embodiment of the present disclosure.
Figure 5:
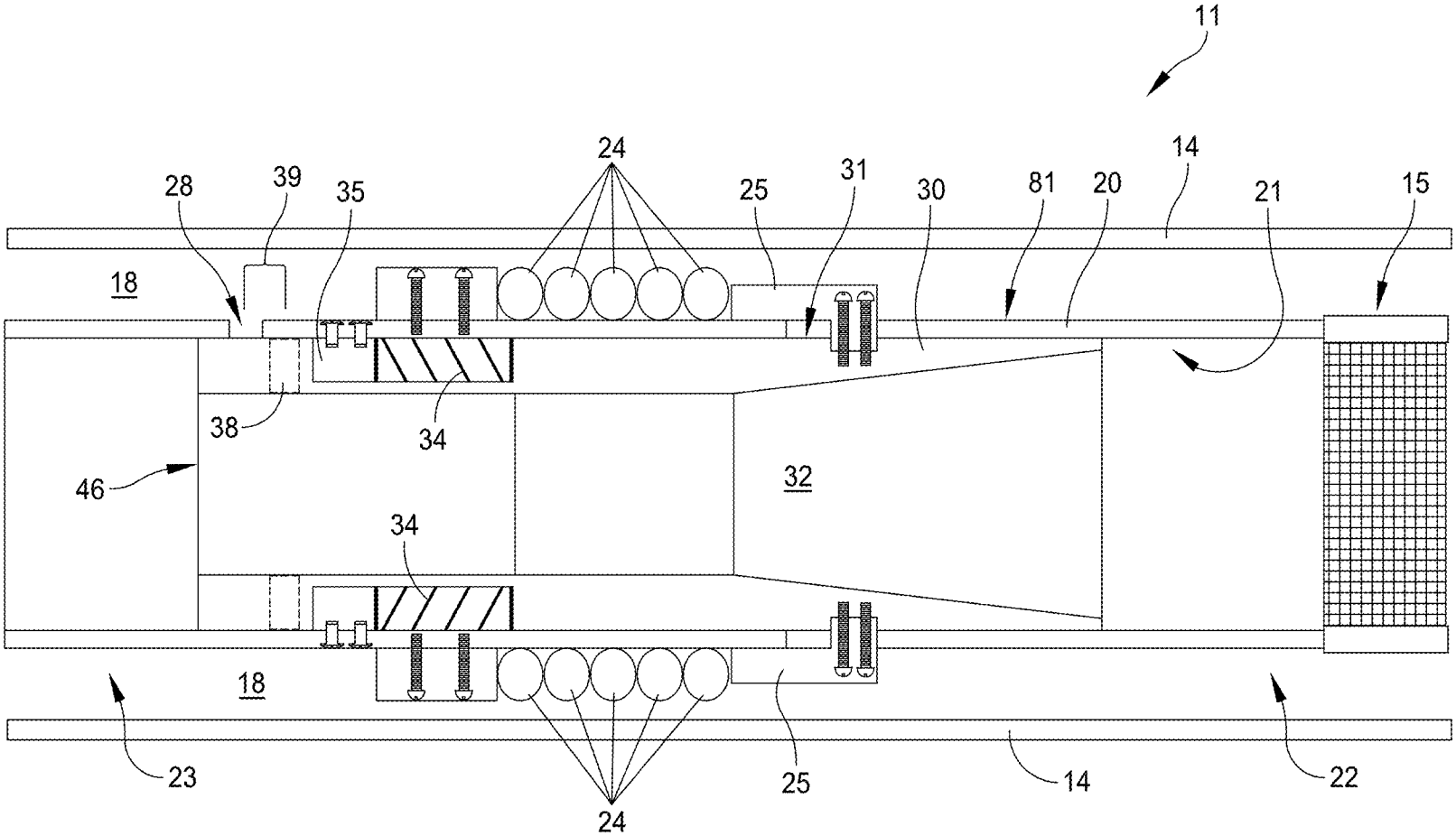
FIG. 5 illustrates a cutaway drawing of a slidable element of the tool with a closed downstream flow port, in accordance with an embodiment of the present disclosure.

Referring to prior art FIGS. 1-2, a modern oil and gas well is depicted with a well bore 12 curving into a lateral production layer with three hydrocarbon fracture zones 70. The well bore 12 may be lined with a well casing 14 backed by cement 76. Well completions, including hydraulic fracturing, may require a tubular injection 79 of a well fluid 19 into the well bore 12 for completing the well. A production tubing may define an annular space between the casing 14 and the tubing. A cluster of perforations (72) may be impacted through the well casing 14 for each intended fracture zone 70, and may be spaced by a production interval (not shown here). Conventional laterals may subdivide the lateral into several dozen production intervals with perforation clusters 72 spaced by 100-300 feet over 1-3 miles.

Hydraulic fracturing may be particularly useful in tight sands, shales and coalbed methane formations, and may include the steps of perforation, acid stimulation, and jetting/washing. The well fluid 19 may include one or more of water, acid, lubricants, crosslink gel, and proppant 74 (e.g., sand or ceramics) of up to 500-3000 lbs./foot. Nitrogen and/or carbon dioxide may also be part of the injection stream. "Well fluids" sometimes refer to formation fluids flowing out of the fracture zones 70, such as oil, gas, water, and fines. The propping agent 74 (proppant) may act to increase a fracture width in the formation after the well fluid 19 has either leaked into the rock formation or produced back through the well bore 12.

Figure 17A:
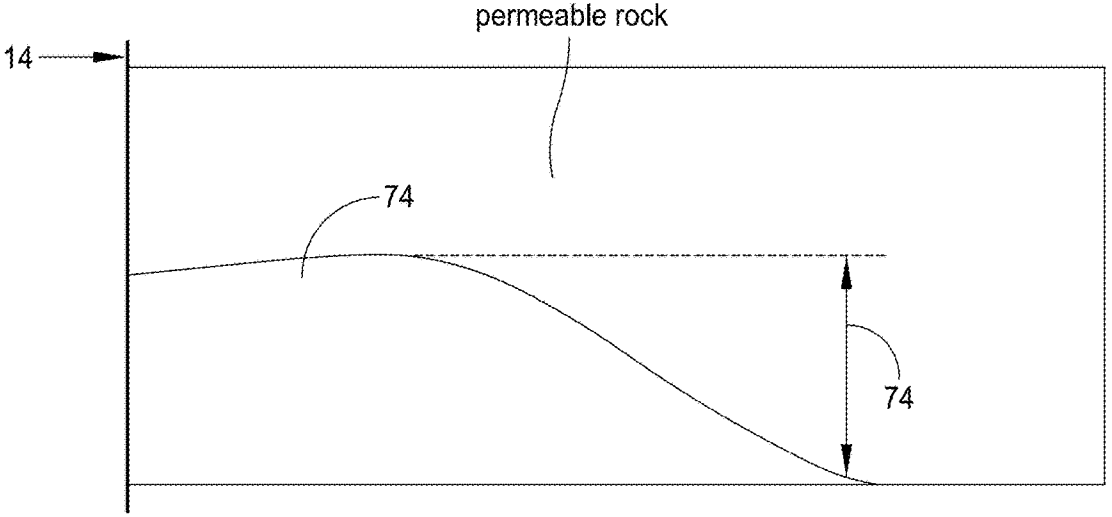
FIGS. 17*a*-17*b* illustrate an improvement in dune formation using an undulatory injection process, in accordance with an embodiment of the present disclosure.
Figure 17B:
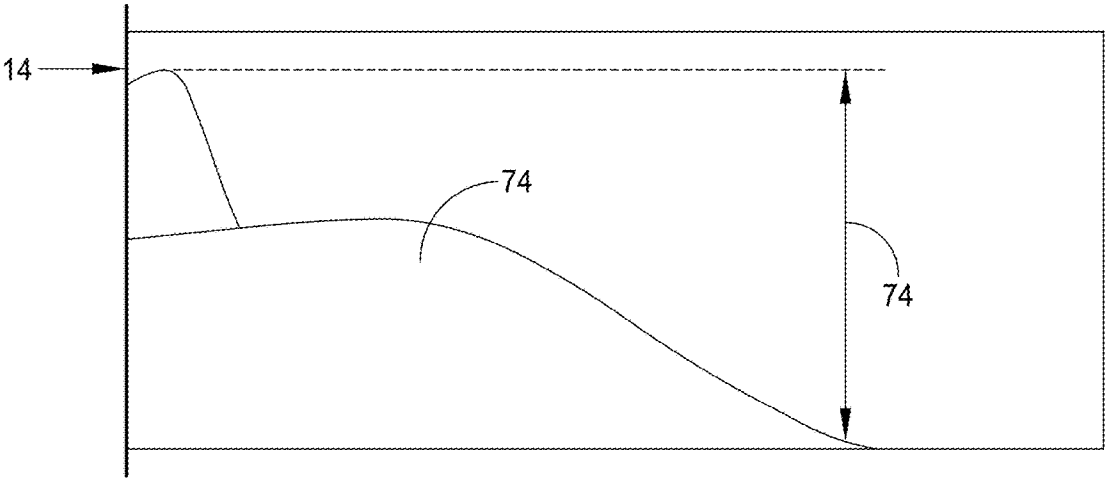

Continuing, a low viscosity well fluid known as slickwater may be injected to carry proppant into the geological formation via a turbulent flow of the well fluid. As the fluid enters the formation, the proppant may settle in the fracture and form dunes that extend well into the fracture (FIG. 17*a*). If these dunes increase in magnitude, they may stop or severely restrict the well fluids from entering the formation, causing a "screen out."

Referring now to FIGS. 3-11, in various embodiments, there is disclosed an isolating tool 11 for selectively orienting the flow of a well fluid 19 with respect to a demarcation 17 in an annulus 18 of a well bore 14. The annulus 18 may be defined by a production tubing 15 inside the well bore, and the tool 11 may attach to a downhole end of the production tubing 15 injecting or receiving the well fluid 19. For the purpose of the following description, the well bore 14 may refer to a drilled hole without a cement liner, or to a metal well casing lining the drilled hole.

The tool 11 may comprise a cylindrical tool housing 20 having a top end 22 connectable to the production tubing 15 and a bottom end 23 opposite the top end 22. The cylindrical housing 20 may be configured to slidably occupy the well bore 14 and may share the annulus 18 therebetween. The bottom end 23 of the housing 20 may or may not be closed, depending on the application, and will be described in more detail below.

Continuing with FIGS. 3-11, in various embodiments, the tool 11 may further comprise a lower cylindrical element 30 positioned, by spring 34 and spring stop 35, within the tool housing 20, and which may be configured to slidably seal its element exterior 31 against a housing interior wall 21 of the tool housing 20. The lower slidable element 30 may include an element bore 32 narrowing toward one end and conductive of the well fluid 19 from the production tubing 15. The positioning spring 34 and narrowing bore 32 may be configured to compress the slidable element 30 in a direction of the narrowing in proportion to an injection velocity of the tubular injection 79. The injection velocity may be measured in gallons per minute (GPM), or may be measured in barrels per minute (BPM).

The positioning spring 34 may comprise one or more springs that are off-axis (FIGS. 3-11, 14-15, 21), or may comprise an axial spring (FIG. 12, 20*b*, 23-26) for resisting the compressive forces of the fluid injection. Additionally, other elastic elements (not illustrated) may cooperate to establish the spring positioning.

The bore 32 narrowing may be a conical narrowing, as shown in FIGS. 3-11, toward a smaller inside diameter ($D_2$), and which may result in an increased velocity (rate of flow) of the well fluid 19 as it passes through the slidable element 30. According to a Bernoulli equation, the FORCE available to move the element 30 is given by:

$$(1/2 * \text{fluid density} * ((V_2)^2 - (V_1)^2) * \prod ((D_2)^2 - (D_1)^2) - \text{frictional drag} - \text{spring force}$$

where $V_2$ and $V_1$ are the fluid velocities at a narrow and a wide inside diameter of the bore, and $D_2$ and $D_1$ are the respective inside diameters. Other narrowing geometries may be utilized to compress the element 30 and to adjust a responsivity to the injection velocity of the tubular injection 79. In response to a pressure of the injected well fluid 19, the positioning spring 34 may compress against spring stop 35 and limit an axial travel of the slidable element 30.

Figure 12:
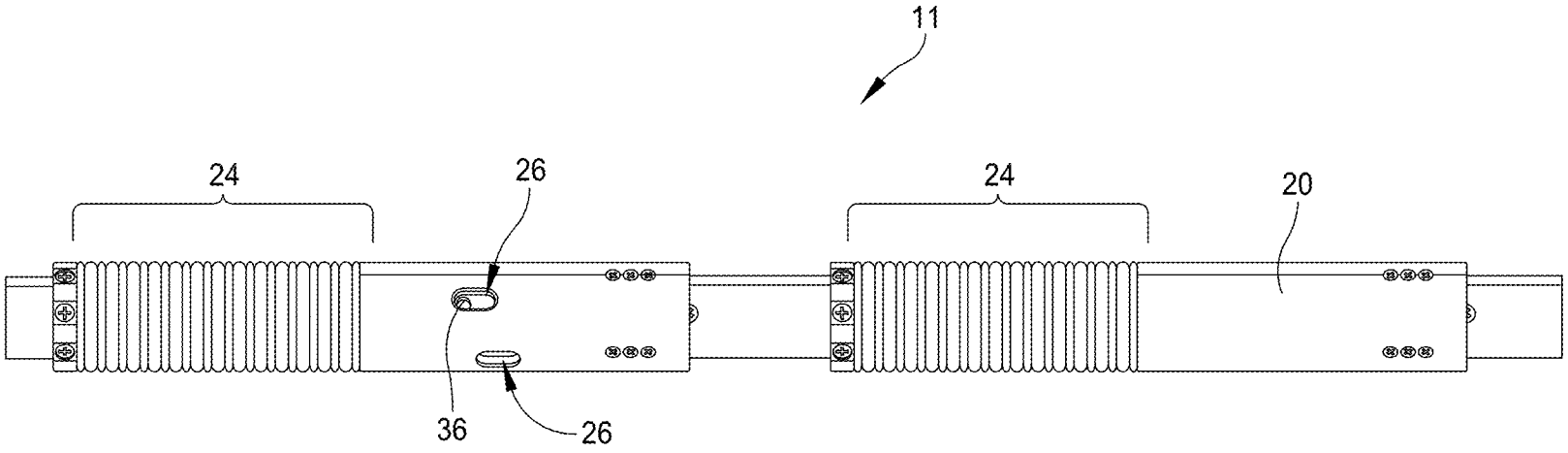
FIG. 12 illustrates a side view of the tool with two annular seals, in accordance with an embodiment of the present disclosure.
Figure 13:
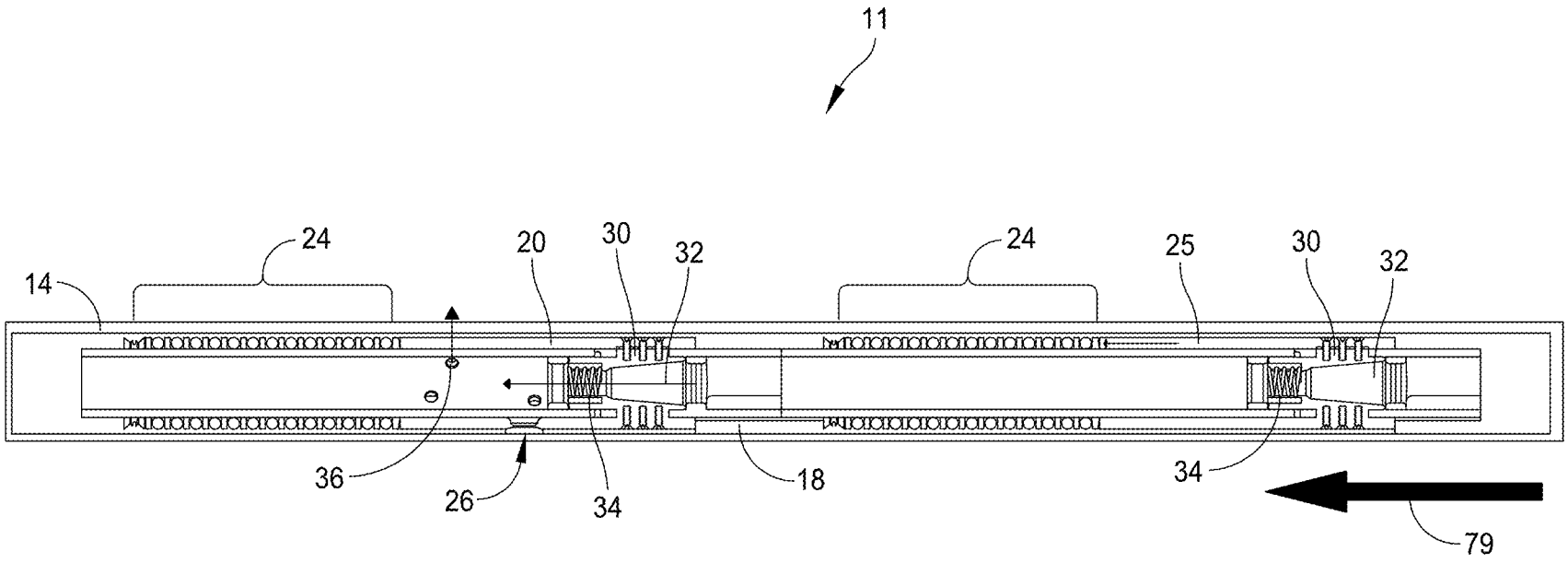
FIG. 13 illustrates a cutaway view of the tool with two annular seals, in accordance with an embodiment of the present disclosure.
Figures 20A, 20B:
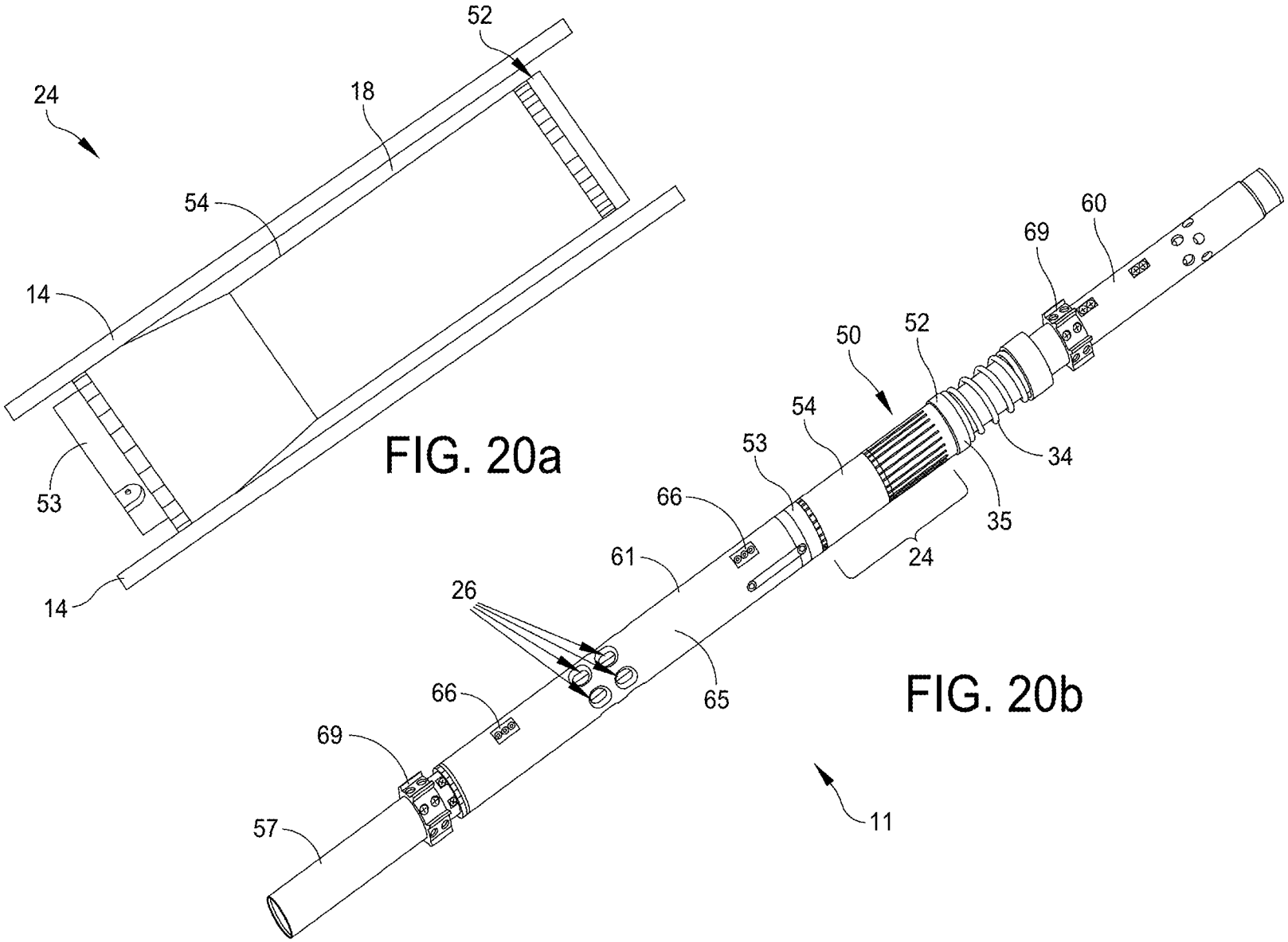
FIGS. 20*a*-20*b* illustrate the flexure sleeve disposed on a housing of the tool, in accordance with an embodiment of the present disclosure.

Referring still to FIGS. 3-11, in various embodiments, the tool 11 may further include a lower expandable annular seal 24 disposable on housing exterior wall 81 of the tool housing 20 for restricting annular fluid flow across the demarcation 17 when expanded. The annular seal 24 may comprise a bank of elastic O-rings, and which may expand radially by compressing the sides axially. For example, for each slidable element 30, there may be five O-rings as shown in FIGS. 3-11, or thirteen or so O-rings as shown in FIGS. 12-13, or a band of shaped rubber. Alternatively, the annular seal 24 may comprise a rubber overmolding 54 expandable by a flexure sleeve 50, as shown in FIGS. 20*a*-20*b* and described below. The annular seal may preferentially form a demarcation 17 against the well bore 14 for encouraging a substantially independent flow of the well fluid 19 upstream or downstream of the seal 24. The tool 11 may thereby allow isolation and treatment of one or more of the hydrocarbon intervals 16 of the well.

Continuing, in various embodiments, the tool 11 may further include a lower seal compression means 25 linked to the slidable element 30 for expanding the lower seal 24 against the well bore 14 when the injection velocity of the well fluid exceeds a lower seal threshold. Exceeding the lower seal threshold may enable a treatment of a hydrocarbon production interval 16 surrounding the well bore 14 above the demarcation 17 (FIG. 9). Alternatively, expanding the lower seal 24 against the well bore 14 may enable the treatment of the interval 16 below the seal 24 (FIGS. 6, 8), depending on aspects of the tool 11 disclosed below. The seal 24 may remain relaxed and retracted from the well bore 14 (FIGS. 3, 5, 7) when the injection velocity is less than the seal threshold.

Still with FIGS. 3-11, in various embodiments, the seal compression means 25 may be a mechanical push tab or push ring, as indicated in FIGS. 3-11 and 13, for compressing or squeezing the sides of O-rings. The compression means 25 may also be a hydraulic pathway to a seal cavity (not shown) behind the annular seal 24 for receiving a pressurized well fluid 19 and expanding the seal 24. Alternatively, the compression means 25 may be a sliding assembly pressing the flexure sleeve 50 of FIGS. 19*a*-20*c* over a conical collar 53 and thereby expanding the seal against the well bore 14. Details of the flexure sleeve 50 are disclosed below.

Elaborating further with FIGS. 3-11, in embodiments not shown, the lower seal threshold may be adjusted (variable) by one or more of a preloading of the positioning spring 34, a spring constant, a bore length, and a degree of bore narrowing. Preloading may provide that the slidable element doesn't move until the injection velocity exceeds a preloaded velocity. Also, the tool 11 may be provisioned for field-tuning the lower seal threshold by one or more of a tensioning screw for preloading the spring 34, a relaxation preset, and an access mechanism for replacing the spring 34. The slidable element 30 may be any free floating mass connected internally or externally to sleeves which actuate the compression means 25. Beneficially, controlling engagement of seal 24 by varying the injection velocity through a narrowing bore 32, and having convenient means for adjusting the seal threshold, avoids the delays and possible damage of mechanical means of operating a packing device.

Referring now to FIGS. 5-9, in various embodiments, the isolating tool 11 may further include an element upstream port 36 connecting the lower element bore 32 to its element exterior 31 at a location upstream of the lower annular seal 24. The housing 20 may additionally include an annular upstream passage 26 for slidably aligning with the port 36 when the injection velocity exceeds an upstream flow threshold, thereby producing an annular upstream flow 27 from the lower element bore 32 (FIG. 9). The housing bottom end 23 may preferably be closed by either a closed bottom or by some other means.

The upstream flow threshold may be adjusted (variable) by setting an axial distance 39 between the port 36 and the passage 26 at a zero injection velocity (FIGS. 5, 7, 9), in addition to the aforementioned variable of spring 34 and bore 32 characteristics. Further, an elongation of the annular passage 26 may be adjusted to vary and increase a range of injection velocities over which annular upstream flow 27 occurs. For example, the annular passage 26 may be oval shaped (FIG. 12-13, 20*b*) in a longitudinal direction for elongating the range of injection velocities of the flow threshold.

Figure 6:
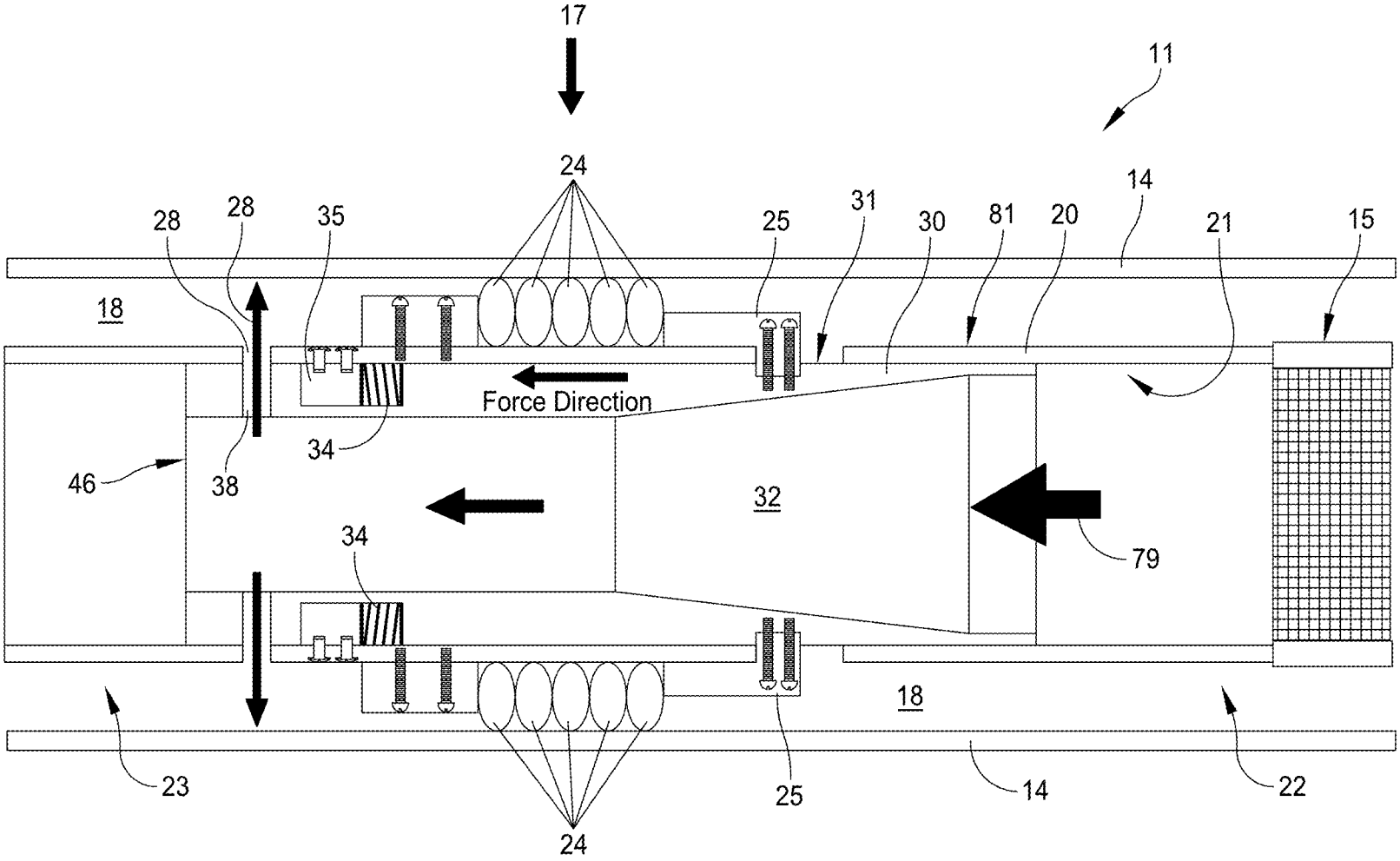
FIG. 6 illustrates a cutaway drawing of the slidable element with an open downstream flow port, in accordance with an embodiment of the present disclosure.
Figure 14:
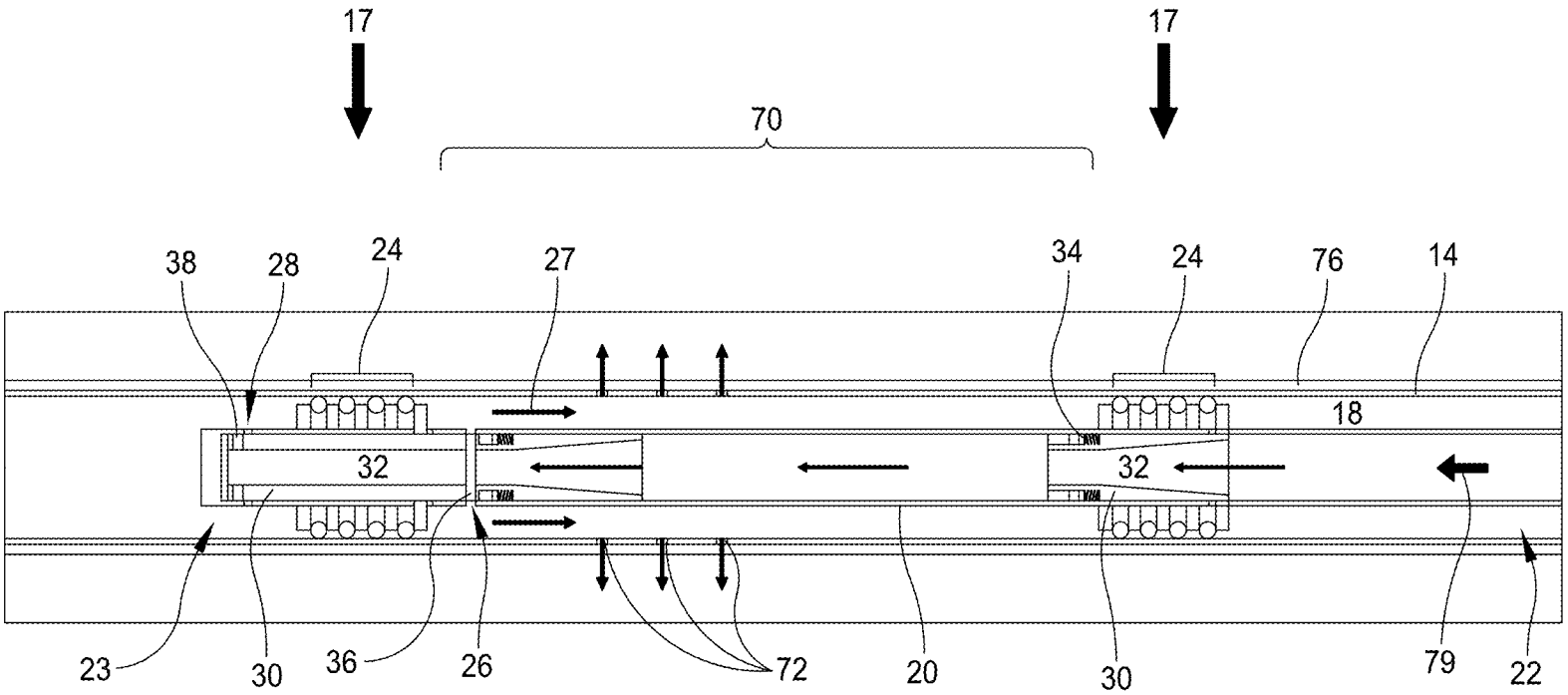
FIG. 14 illustrates a cutaway drawing of the tool stimulating a production interval of a well bore, in accordance with an embodiment of the present disclosure.
Figure 15:
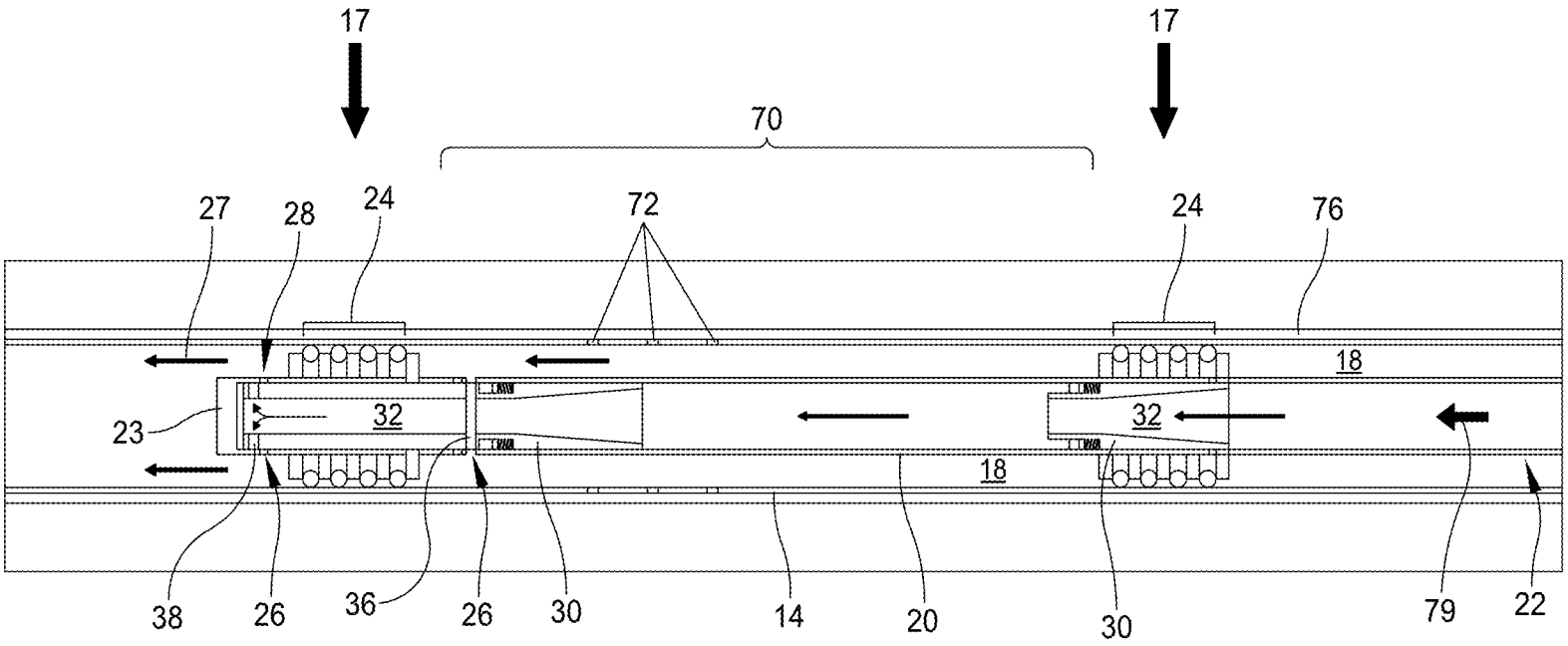
FIG. 15 illustrates a cutaway drawing of the tool flushing the production interval of the well bore, in accordance with an embodiment of the present disclosure.
Figure 16A:
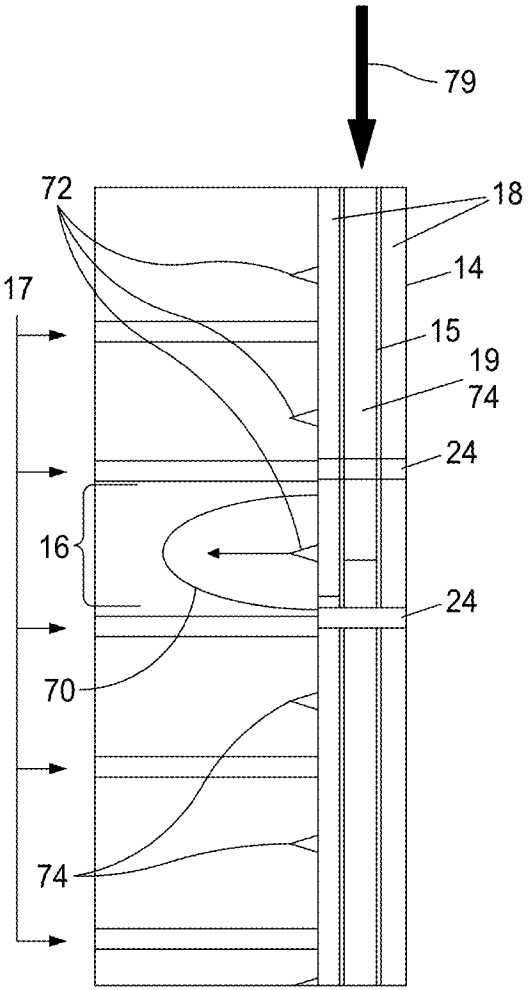
FIGS. 16*a*-16*c* illustrate an improved wetting process using the isolating tool, in accordance with an embodiment of the present disclosure.
Figure 16B:
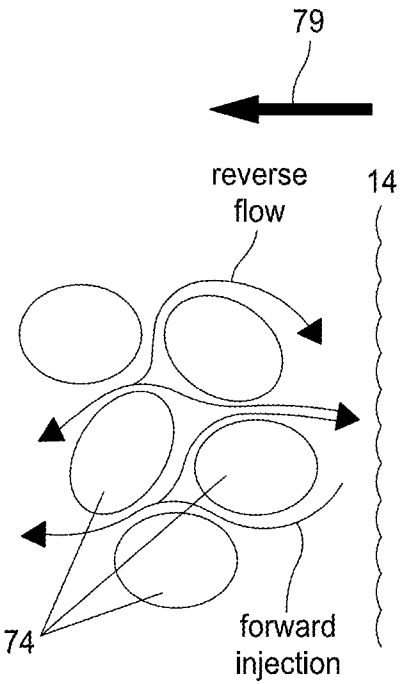
Figure 16C:
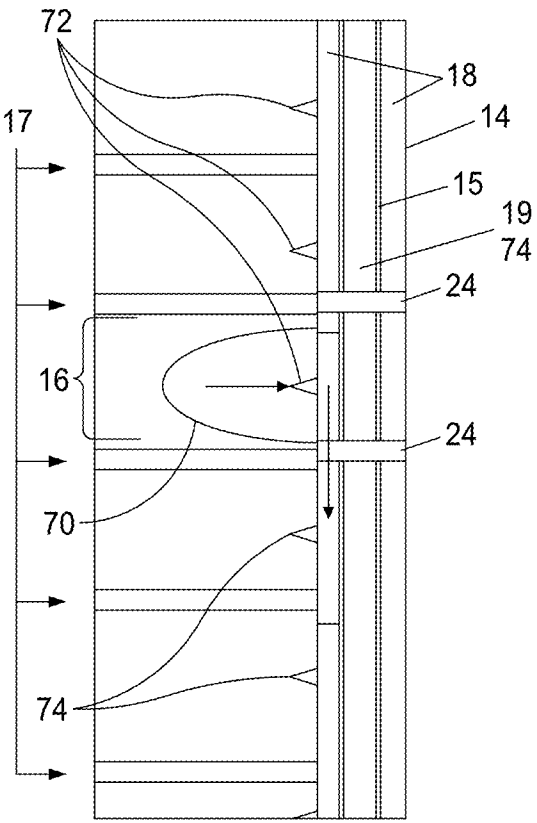

Continuing now with FIGS. 5-9 and 14-15, in various embodiments, the isolating tool 11 may also include an element downstream port 38 connecting the lower element bore 32 to the element exterior 31 below the lower seal 24. An annular downstream passage 28 in the housing 20 may also be provided in axial alignment with the element downstream port 38. The port 38 and the passage 28 may be configured to slidably align when the injection velocity falls below a downstream flow threshold. The shape of the passage 28 may be elongated axially to provide annular downstream flow 29 down to a zero injection velocity (FIGS. 6, 8, 15). The bottom end 23 of the housing 20 may preferentially be closed off in order to allow element port 38 to direct fluid flow at velocities below the downstream flow threshold. In an alternate embodiment not shown, the port 38 and the passage 28 may be configured to align when the injection velocity exceeds the downstream flow threshold, thereby directing annular downstream flow 29 for stimulating a production interval 16 downstream of the lower seal 24.

Referring now to FIGS. 12-15, 21, and 23-24, in various embodiments, the isolating tool 11 may be configured with two slidable elements 30 for selectively orienting the flow of the well fluid 19 with respect to two demarcations 17 bracketing a fracture zone 70. In a preferred embodiment, the isolating tool 11 may include an upper slidable element 30 spring-positioned 34 within the tool housing 20 and upstream of the lower slidable element 30. The upper element 30 may be configured with a narrowing bore 32 for compression toward its narrowing end in proportion to the injection velocity, and may include an upper compression means 25 for expanding an upper annular seal 24 against the well bore 14 when the injection velocity exceeds an upper seal threshold. The lower and the upper slidable elements 30 may provide for an isolated pressurizing of the straddled fracture zone 70 through its respective perforation cluster 72.

Continuing, the upper slidable element 30 may also include an element upstream port 36 for directing an annular upstream flow 27 through an aligned annular upstream passage 26 in the housing 20. And, the upper slidable element 30 may also include an element downstream port 38 for directing an annular downstream flow 29 through an aligned annular downstream passage 28 in the housing 20. In one of the preferred embodiments, the upper slidable element may be configured to actuate only the upper annular seal 24 and may not have any flow ports (FIGS. 12-15).

Referring now to FIGS. 19*a*-20*b* and 23-24, in a preferred embodiment, the upper and the lower expandable annular seals 24 may each comprise a conical collar 53 disposable around an outer sleeve 61*b* of the housing 20 at the respective well bore demarcation 17 (FIG. 20*b*). In this embodiment, the slidable element 30 may be slidably connected externally, by means described below, to an outer sleeve 61*b* configured to compress the conical collar 53. The collar 53 may be axially sloped outward in a direction of seal 24 compression. A cylindrical flexure sleeve 50 may be formed of multiple sleeve tines 51 ringed at one end by a sleeve ring 52 for receiving pressure from the seal compression means 25 during fluid injection. The multiple sleeve tines 51 may be free floating at the other end for slidable expansion over the conical collar 53.

Continuing, a rubber overmolding 54 may substantially wrap the flexure sleeve 50 and may slidably and radially expand at the respective demarcation 17 when acted upon by the respective slidable element 30. When the injection velocity exceeds the upper and the lower seal thresholds, the rubber overmoldings 54 may expand to seal the annulus 18 at both demarcations 17 for treating the fracture zone 70. Beneficially, this flexure sleeve 50 may provide an expandable seal 24 without compressing and deforming the sides of one or more rubber sealing rings, and therefore may avoid the wear and tear of traditional packers. The sloping surface of the conical collar 53 may be oriented to be widest near the housing bottom end 23 so that an upward tug on the tubing string 15 and tool body (FIG. 20*b*) may release a stuck seal 24.

Figure 7:
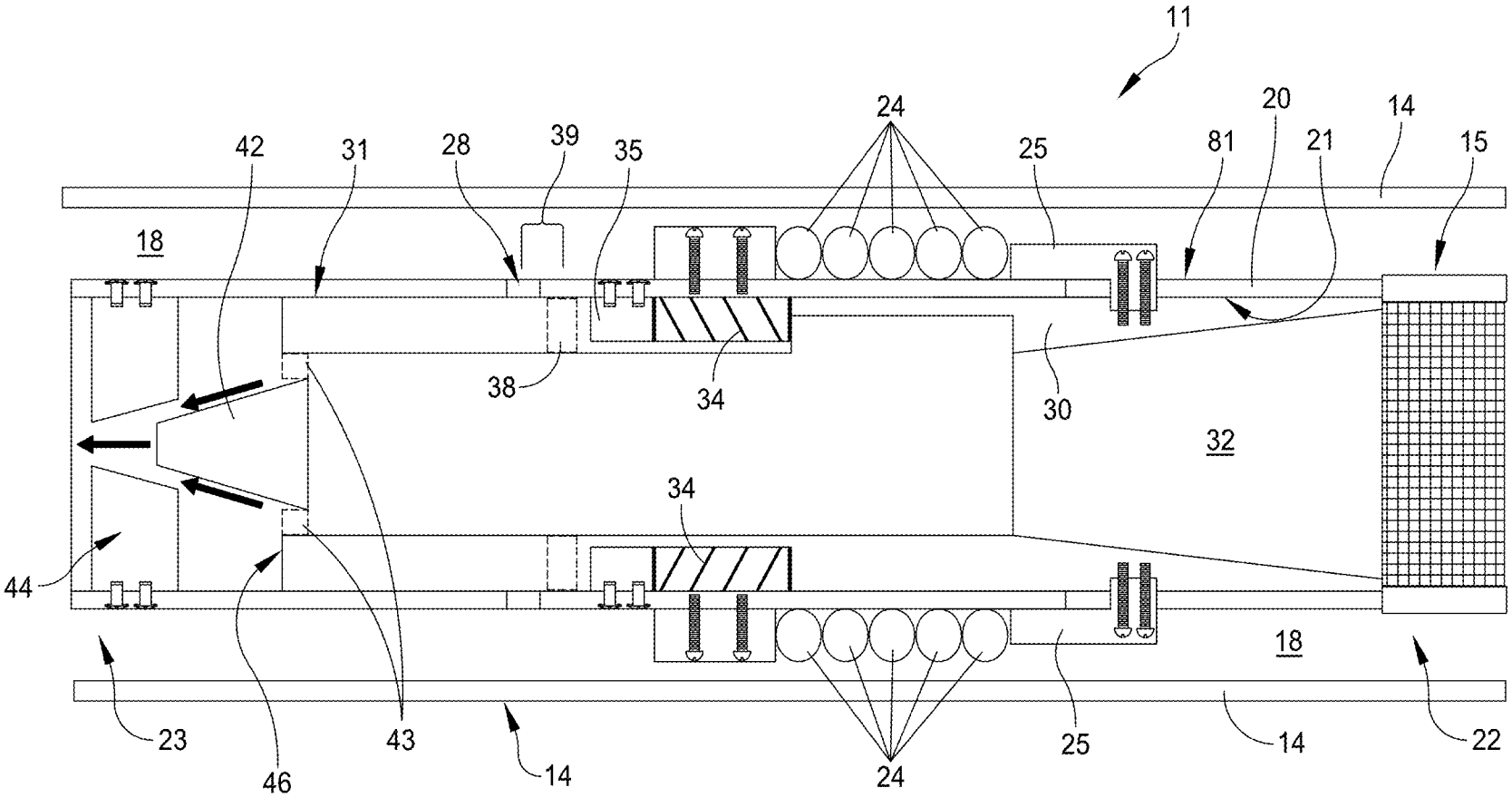
FIG. 7 illustrates a cutaway drawing of an isolating tool with an open axial bypass valve, in accordance with an embodiment of the present disclosure.
Figure 8:
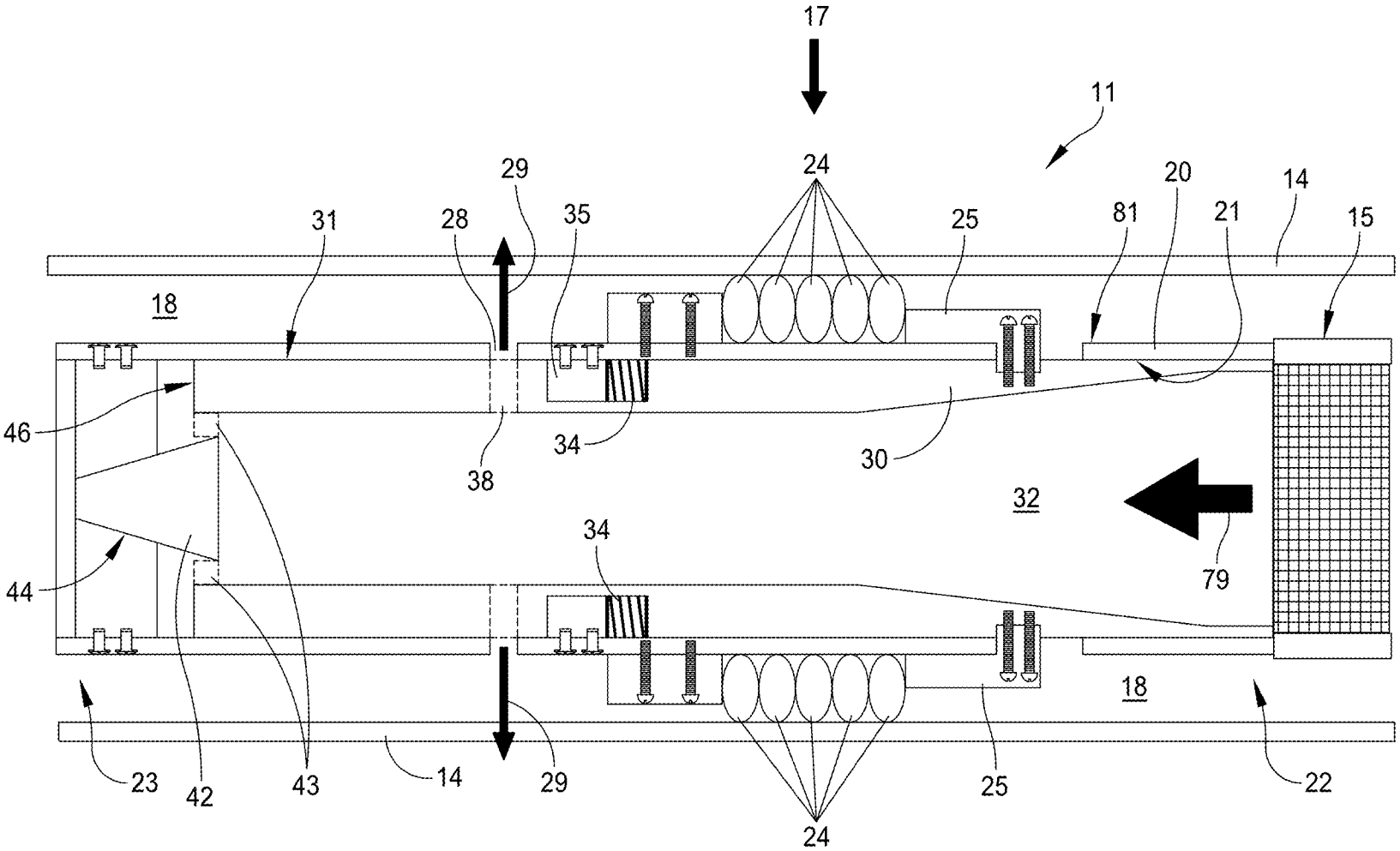
FIG. 8 illustrates a cutaway drawing of an isolating tool with a closed axial bypass valve, in accordance with an embodiment of the present disclosure.
Figure 9:
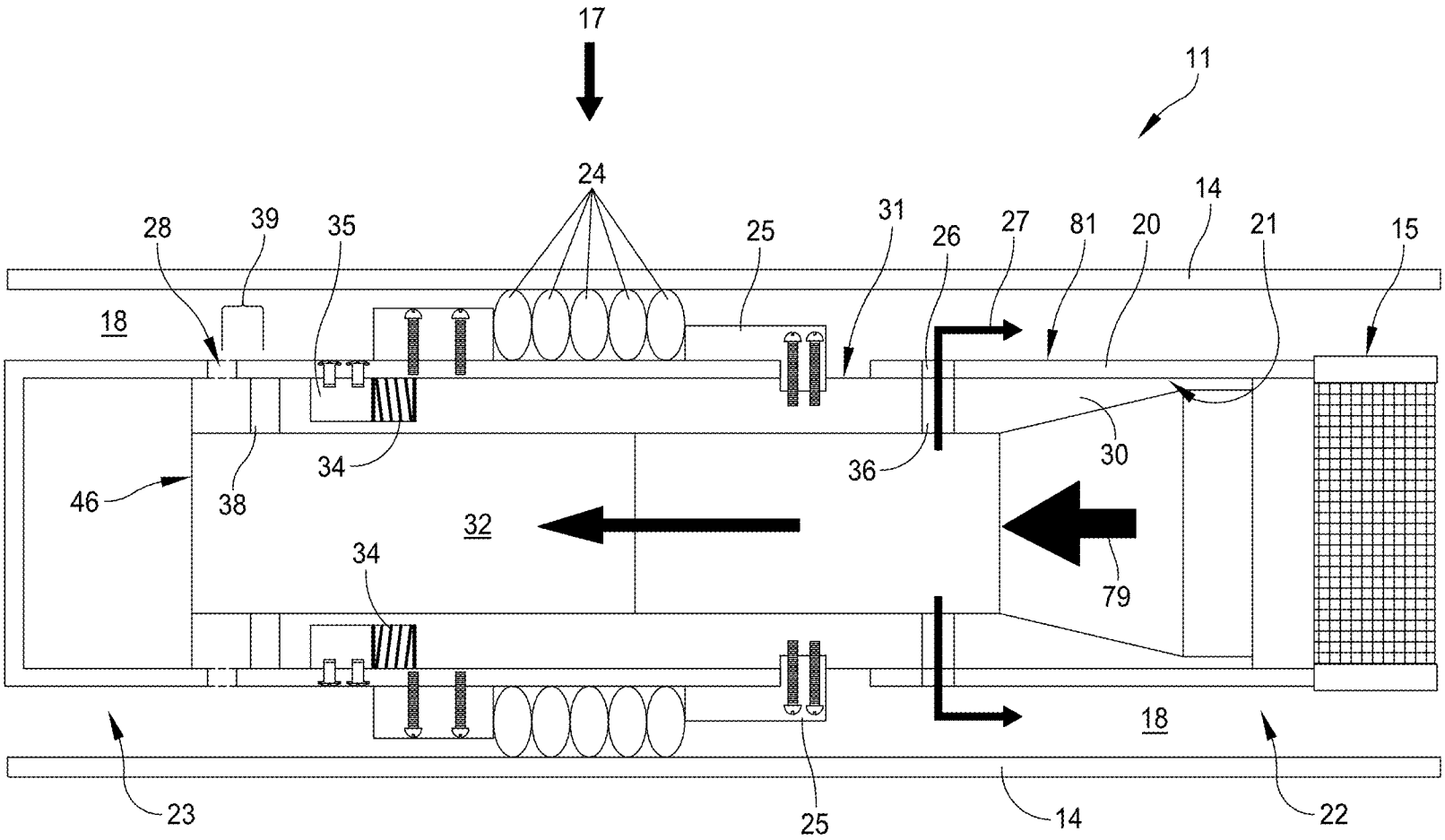
FIG. 9 illustrates a cutaway drawing of the slidable element with two flow ports, in accordance with an embodiment of the present disclosure.
Figure 26:
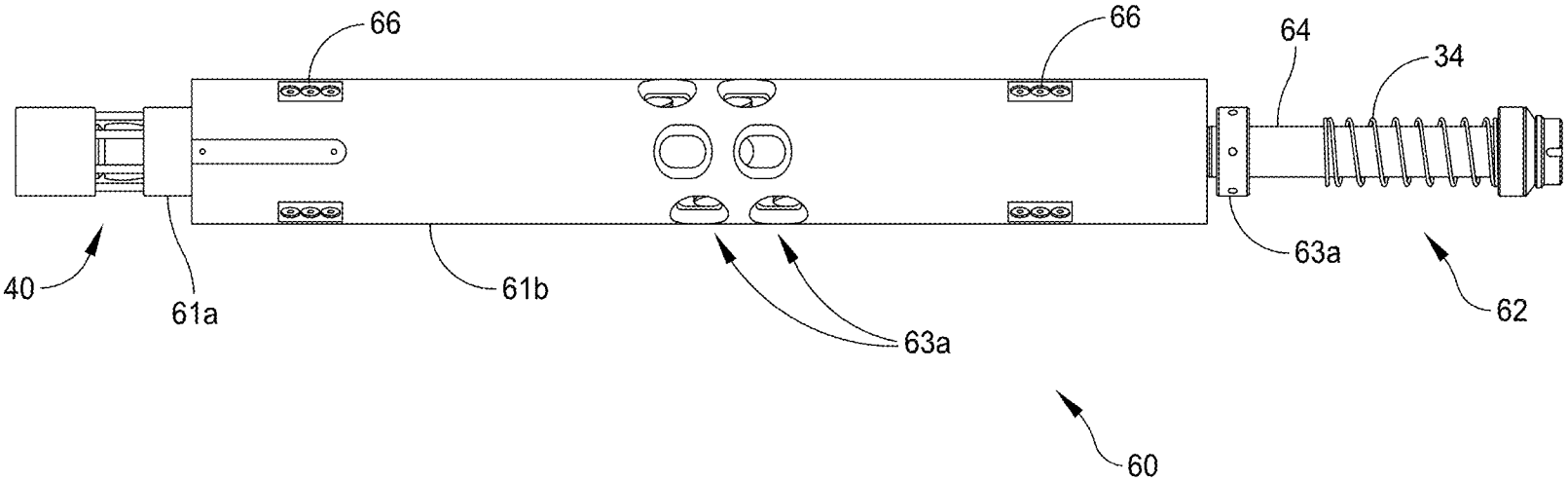
FIG. 26 illustrates a sliding assembly for mounting the choke, in accordance with an embodiment of the present disclosure.

Referring now to FIGS. 7-8 and 26, the isolating tool 11 may include an axial bypass assembly 40 downstream of the lower annular seal 24 for closing tubular outflow from the housing bottom end 23, and for pressurizing the fracture zone 70. The axial bypass 49 may comprise a conical plug 42 terminating a central portion of an element bottom end 46 of the lower slidable element 30, and a drain opening 44 gating a central portion of the housing bottom end 23. The drain 44 may be sealingly receivable of the conical plug 42 when the injection velocity is greater than a bypass threshold. One or more plug vents 43 around the central portion may pass well fluids 19 when the axial bypass 40 is open. An alternate method for closing off the housing bottom end 23 is to simply cap the bottom end 23, as shown in FIGS. 14-15 and 31.

Figure 11:
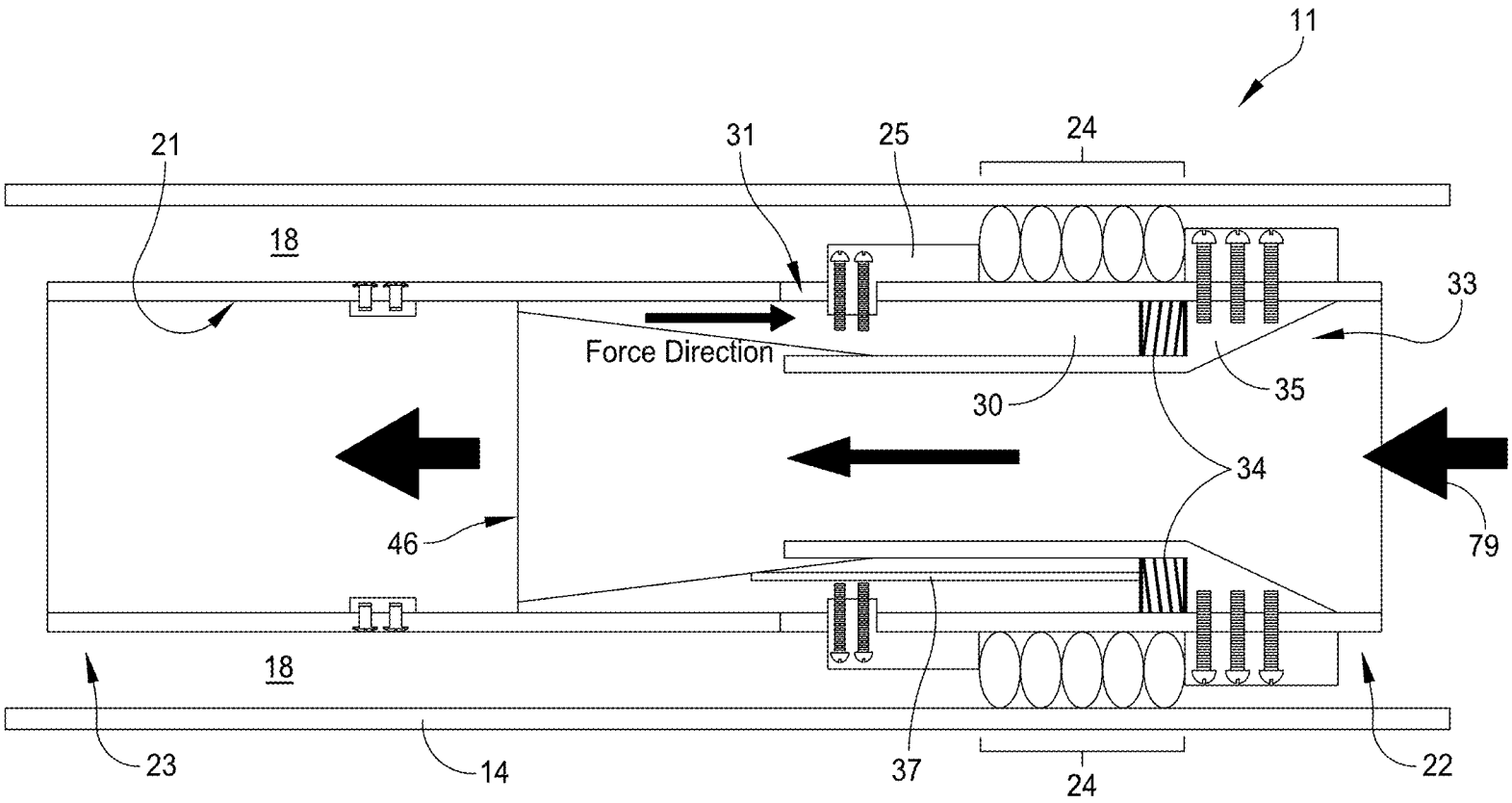
FIG. 11 illustrates a cutaway drawing of the slidable element with a reversed bore narrowing, in accordance with an embodiment of the present disclosure.

Considering FIG. 11, in an embodiment, the element bore 32 of one or both of the upper and the lower slidable elements 30 may narrow toward the housing top end 22 for compressing the element 30 in a direction opposite to that of the injection velocity. While the bore 32 may preferentially narrow in a downstream (downhole) direction for simplicity, the reverse orientation shown in FIG. 11 may enable the compression means to push in an opposite direction when that is an advantage. The tool 11 may require bore funnel 33 to pre-accelerate the tubular injection 79 so that a reverse force might be delivered to the slidable element 30.

Referring to FIGS. 14-18*b*, we now consider a first application of the present disclosure for well completion where the isolating tool 11 has two elements 30 and two dissimilar velocity thresholds. A method of treating the production interval 16 may include attaching the tool 11 to the production tubing 15, lowering the cylindrical housing 20 to a sealing depth for bracketing a perforation cluster 72 in the well bore 14, injecting the well fluid 19, and selecting an injection velocity sufficient to expand one or more of the annular seals 24 against the well bore 14. The method may further comprise setting the injection velocity to direct an annular flow downstream or upstream of one of the expandable seals 24.

Referring still to FIGS. 14-18*b*, an undulatory stimulate-and-flush sequence is proposed. The method may comprise setting the minimum sealing threshold for the upper of the two annular seals at a relatively low velocity, setting the minimum sealing threshold for the lower of the two annular seals at a relatively high velocity, and adjusting the axial distance between the upstream and the downstream ports such that the annular downstream flow ceases and the annular upstream flow ensues when exceeding the relatively high velocity. The method may further comprise injecting the well fluids at the high velocity to stimulate the hydrocarbon interval 16, and remaining at that injection rate for some minutes (FIGS. 14, 16*a*, 18*a*-18*b*). Here, annular upstream flow 27 occurs through the element upstream port 36 while the element downstream port 38 is closed. Then, the injection rate may be reduced to an intermediate velocity for flushing the production interval 16 and the tool passages (FIG. 15, 16*b*, 18*a*-18*b*). At this reduced velocity, the annular downstream flow 29 occurs and the lower seal 24 is relaxed, allowing the well fluids 19 and proppant 74 to flow out of the formation and downstream. The forward momentum ceases and proppant in the fractures is invited to settle.

Advantageously, this first application illustrates a 'remote control' feature of the disclosed invention, where two operational configurations may be remotely actuated, by varying the injection velocity, for engaging/relaxing the seals 24 and for directing the annular flow (upstream or downstream). Additionally, the seal and the flow thresholds may be adjustable by varying the positioning spring 34, bore 32 dimensions, and the axial location and shape of the element ports 36 and 38 and the annular passages 26 and 28.

Figure 18A:
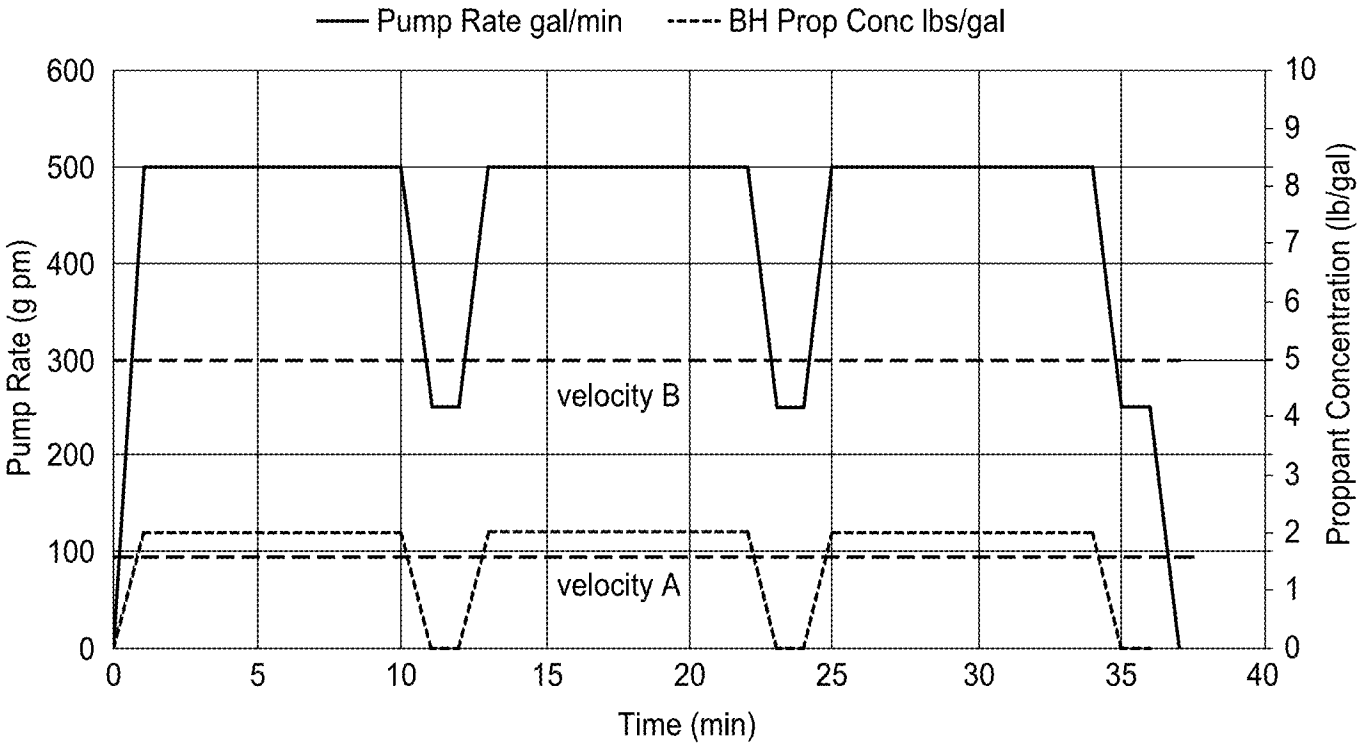
FIGS. 18*a*-18*b* illustrate undulating an injection velocity of well fluids for managing the dune formation, in accordance with an embodiment of the present disclosure.
Figure 18B:
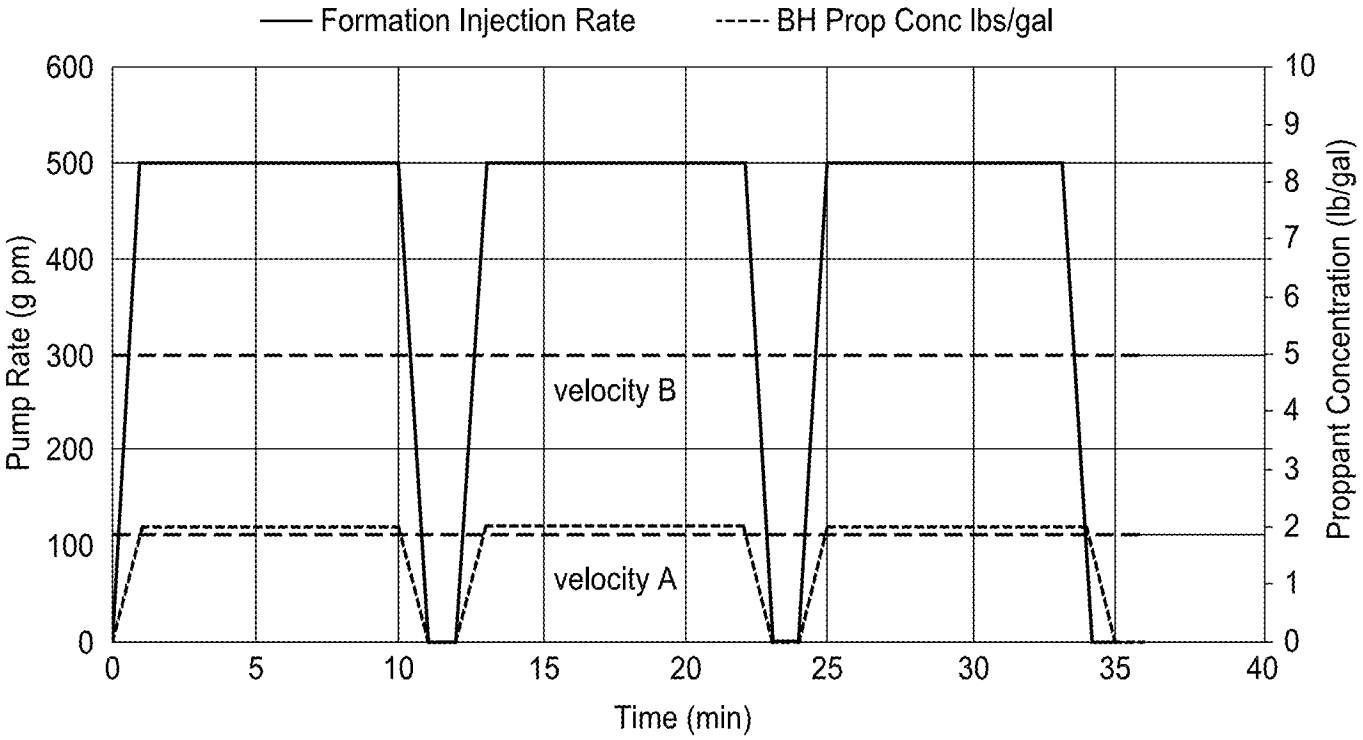
Figure 19B:
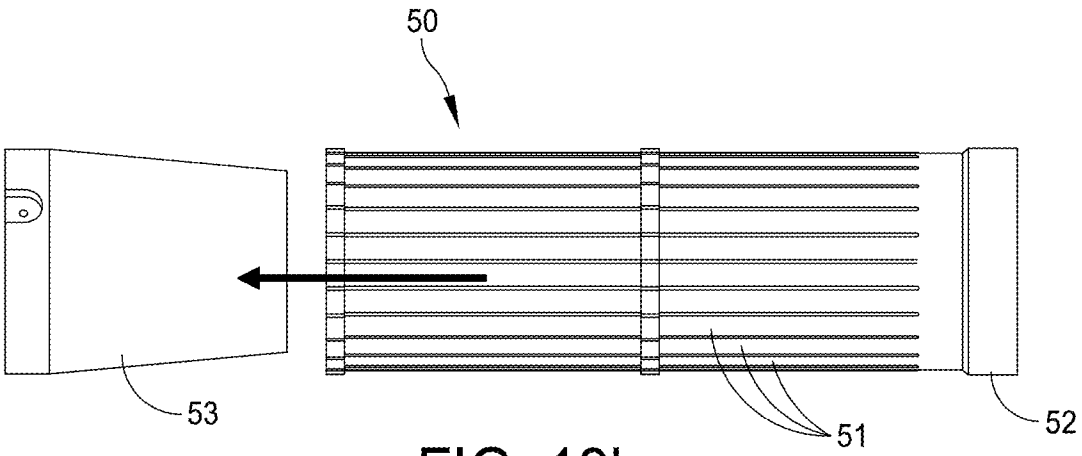
FIGS. 19*a*-19*c* illustrate a flexure sleeve for expanding the annular seal, in accordance with an embodiment of the present disclosure.
Figure 19C:
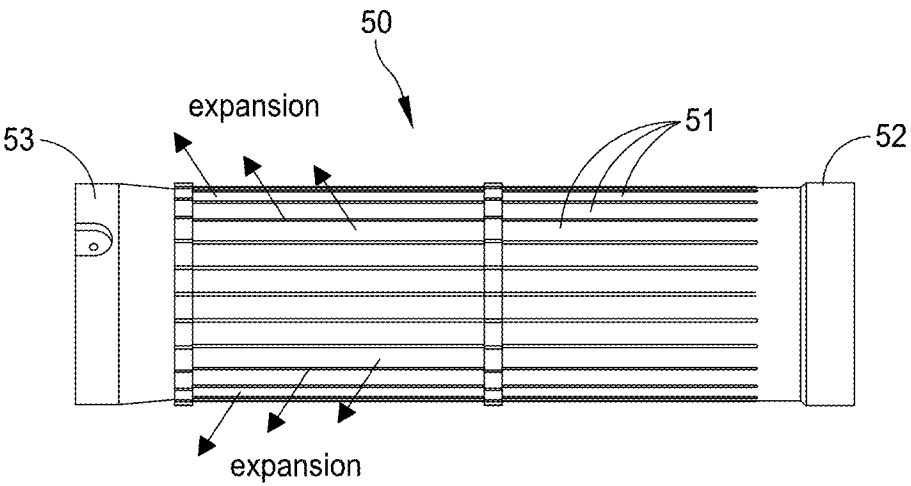
Figure 19A:
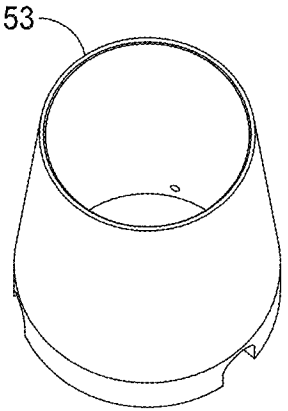

Continuing with FIGS. 18*a*-18*b*, this stimulate-and-flush application may prevent or repair a screen out event and avoid the unrestrained flowback of the well. Alternating between stimulation and flushing may also form a more ideal dune shape (FIG. 18*b*) for greater oil and gas yield. For example, the upper seal threshold may be set to velocity of 100 gallons per minute (GPM), and the lower seal threshold set to 300 GPM, below which the lower element downstream port 38 may be open. At specified intervals, a slickwater "flush fluid" lacking proppant may flush through the formation at a lower injection velocity of, for example, 250 GPM, removing excess proppant and exiting the interval through the open lower element. After an appropriate settling time, the injection velocity may be increased to, for example, 500 GPM, thereby opening the element upstream port 36 of the lower element 30 and injecting fluid into the fracture zone 70. During this higher injection velocity, 2-6 lbs. of proppant 74 may be added to each gallon of slickwater to form a healthier dune shown in FIG. 17*b*.

This alternating cycle of the annular flow direction may be repeated numerous times for a controlled deposition of the proppant 74, creating strength and width in the fractures. In another embodiment, the undulation described above may be applied to wetting chemicals such as surfactants and certain acids, which may improve a recovery of hydrocarbons from the treated formation. These chemicals may enter the fracture (FIG. 16*b*) and coat the rock faces and pores they flow by. When the element downstream port of the lower element is opened, a pressure at the casing perforations may drop and the fluid flow may reverse direction. When the fluid reverses course, previously uncontacted side of extrusions, rock faces, and proppant are exposed to the wetting chemicals.

Figure 21:
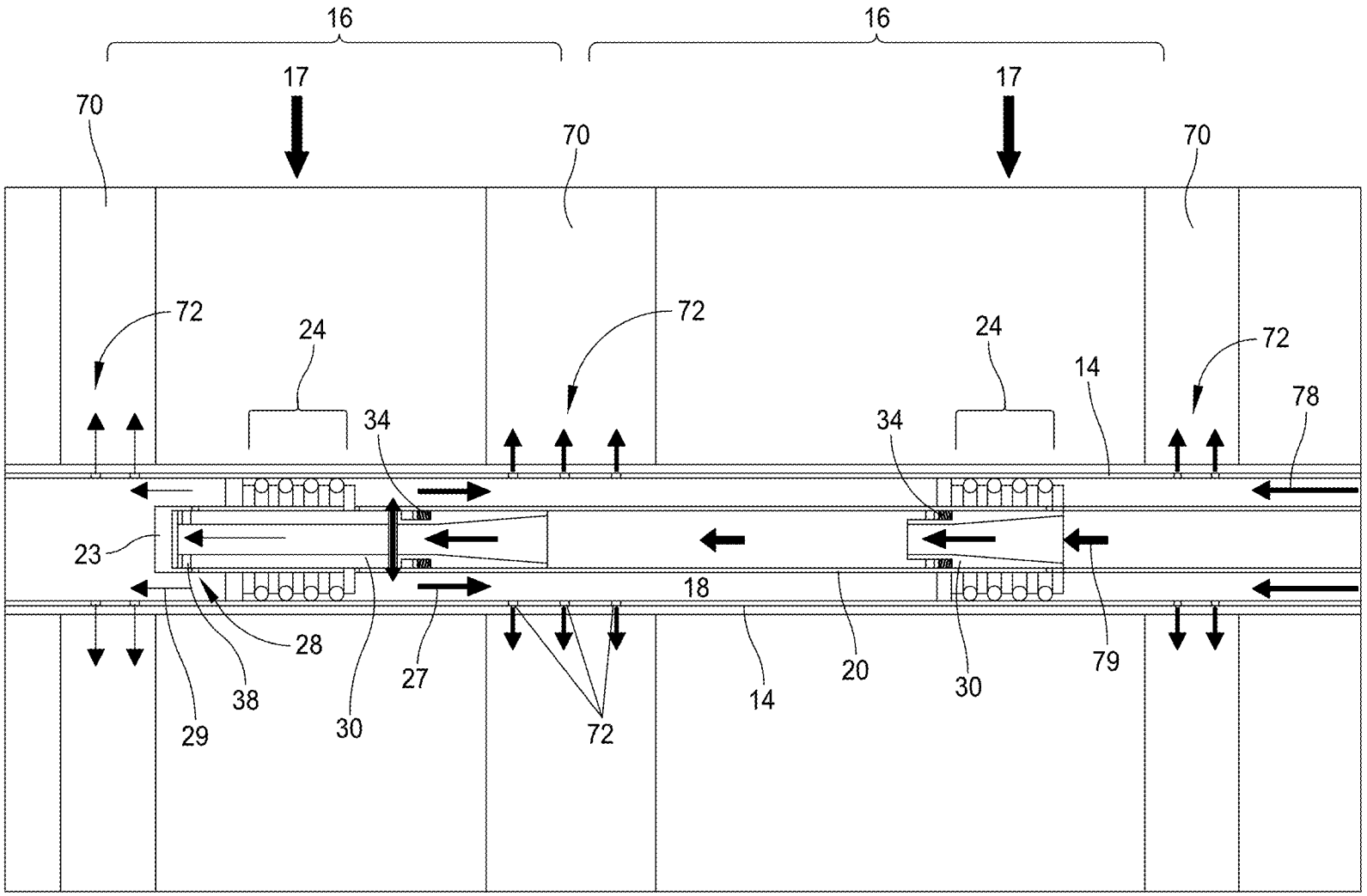
FIG. 21 illustrates a completion process for three production intervals, in accordance with an embodiment of the present disclosure.
Figure 22:
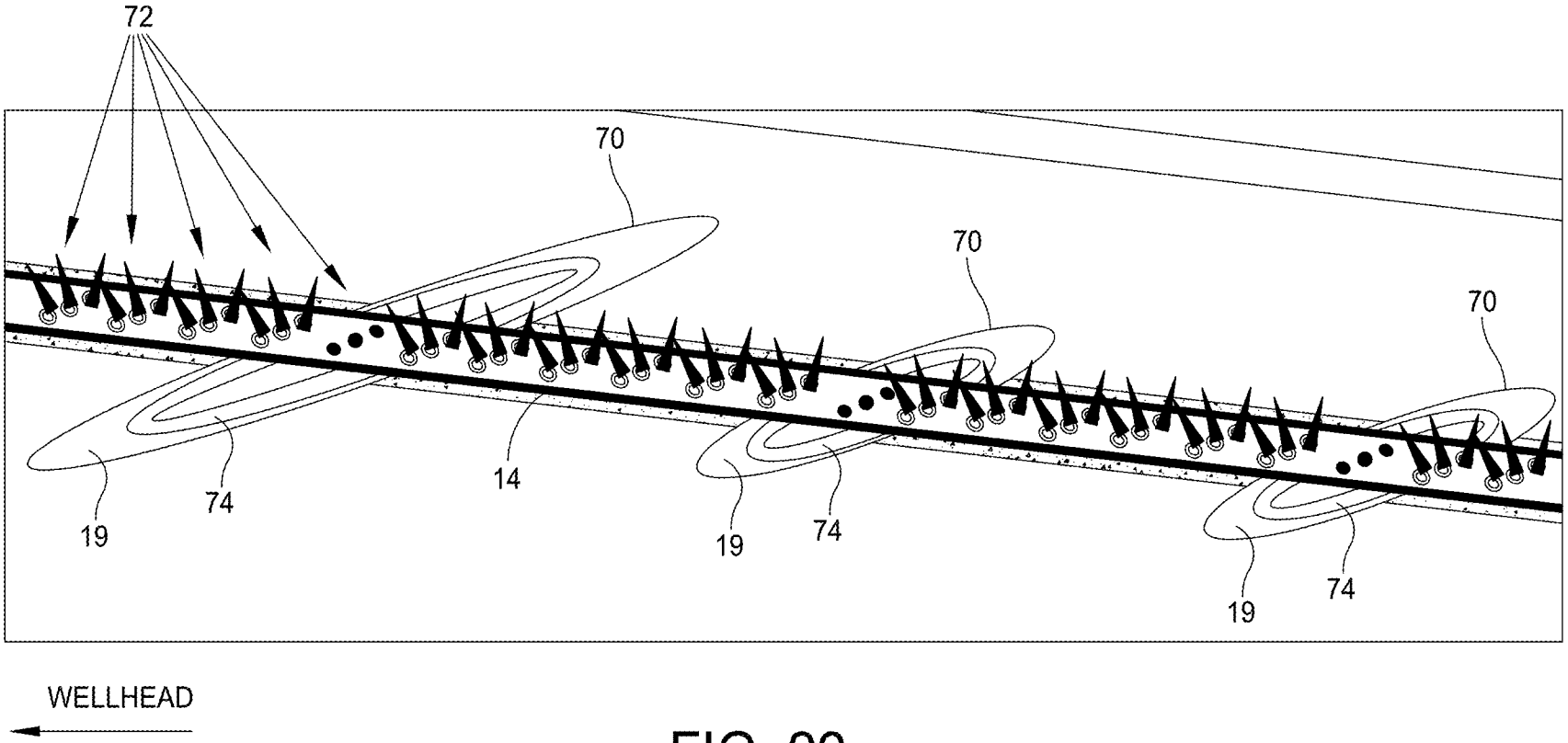
FIG. 22 illustrates subdividing an existing production interval into many new intervals, in accordance with an embodiment of the present disclosure.

Referring to FIG. 21, we now consider a second application of the present disclosure for completing three adjacent fracture zones 70 with a single deployment of a two-element tool 11. Here, we may employ a different constellation of dissimilar velocity thresholds compared to the first application described above, and which may be preset in the field prior to going down hole. This three-interval method may comprise setting both the upper and the lower seal thresholds at a relatively low injection velocity, and setting both the upstream and the downstream flow thresholds at a relatively high velocity. Next, the tool 11 may be lowered into a lateral having the three production intervals 16 needing fracturing, lining up the perforation clusters 72 between the demarcations 17.

The method may further comprise increasing the velocity of the tubular injection 79 to slightly exceed the seal thresholds of, for example, 100 GPM, whereupon the middle zone 70 may be isolated and the annular downstream flow 29 of the well fluids 19 may ensue, indicated by the light gauge arrows in FIG. 21. Annular injection 78 may also be initiated for independently stimulating the upper zone 70 above the upper annular seal 24. The method may further comprise increasing the rate of the tubular injection 79 to exceed the upstream and the downstream flow thresholds of, for example, 300 GPM, whereupon the middle zone 70 may be stimulated by the well fluids 19 as the annular upstream flow 27 ensues and the annular downstream flow 29 ceases, indicated in FIG. 21 by the heavy arrows. Annular injection 78 of the upper zone 70 and the tubular injection 79 of the middle zone 70 may be effected simultaneously.

Continuing with FIG. 21, in an embodiment, once middle-zone 70 stimulation has continued for some time, the method may further comprise relaxing the tubular injection to an intermediate velocity of, for example, 200 GPM, whereupon the annular upstream flow 27 ceases and the element downstream port 38 opens to stimulate the lower fracture zone 70. Although this application required two slidable elements 30 and seals 24, the tool 11 may be disposed with three or more elements 30 and respective seals 24 for treating additional intervals 16 with one deployment by establishing three or more velocity thresholds for the seals 24, downstream flow 29, and upstream flow 27. Another example along these lines follows below.

Referring now to FIGS. 21-24 and 28*a*-28*d*, in various embodiments, a third application for tool 11 is described. A conventional lateral may contain widely spaced perforation clusters 72 with much unfractured hydrocarbon reserves between the original fracture zones 70. We will now describe how the prior art lateral of FIG. 2 may be subdivided into 6 new perforation clusters 72 per interval 16 in FIG. 22 and stimulated using the disclosed tool 11 in one deployment. The method of subdividing an old lateral may comprise forming 6 new perforation clusters 72 per interval 16 using a tubing-conveyed perforation gun. The tool 11 may be equipped with five annular seals 24 for bracketing four zones (A through D), each seal 24 expandable by a corresponding slidable element 30 configured with a narrowing bore 32 and linked by the compression means 25 to the annular seal 24 (FIG. 24*a*-24*d*). The housing bottom end 23 may be closed.

Continuing, the seal thresholds may be configured to escalate in velocity going from the 1st to the 5th seal 24, thereby bracketing an additional fracture zone 70 for each stage of zone stimulation. For example, the seal threshold progression from lowest to highest might be 100 GPM, 100 GPM, 150 GPM, 200 GPM, and 250 GPM. The method may further comprise configuring the lower slidable element (not shown in FIG. 28*a*-28*d*) with the downstream 38 and upstream 36 flow ports, configuring the middle three elements with only the upstream flow ports 36, and configuring the upper element (5th) without any flow ports since we will not be stimulating the zones above the tool 11 in this example. The upper and the lower seal thresholds for the lowest (1st) slidable element may be set to approximately the same velocity as the next higher seal threshold (2nd seal, in this case), thereby opening the upstream port 36 for the bracketed zone. Therefore, the method may include setting the escalating upstream thresholds at 100 GPM, 150 GPM, 200 GPM, and 250 GPM, respectively, for the $1^{st}$_$4^{th}$ elements. The downstream threshold of the $1^{st}$ element may be set to 100 GPM to allow outflow from the tool 11 when no upstream ports are open (<100 GPM).

Figure 23:
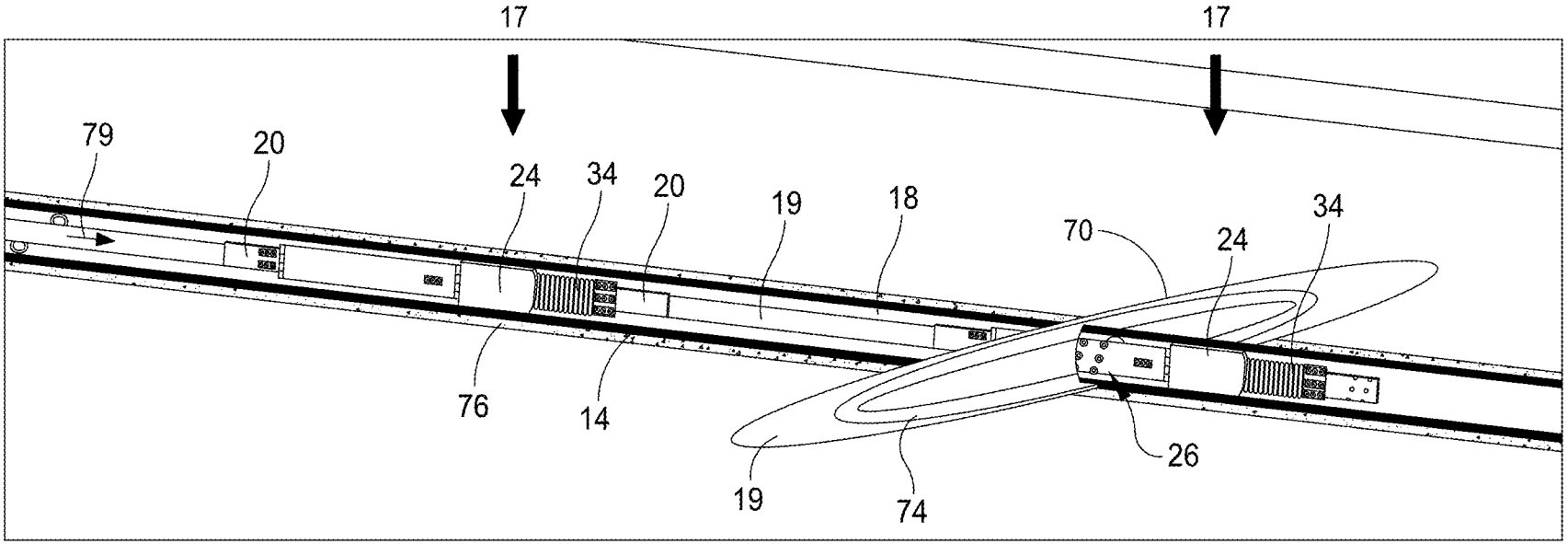
FIG. 23 illustrates stimulating one of the new production intervals, in accordance with an embodiment of the present disclosure.
Figure 24:
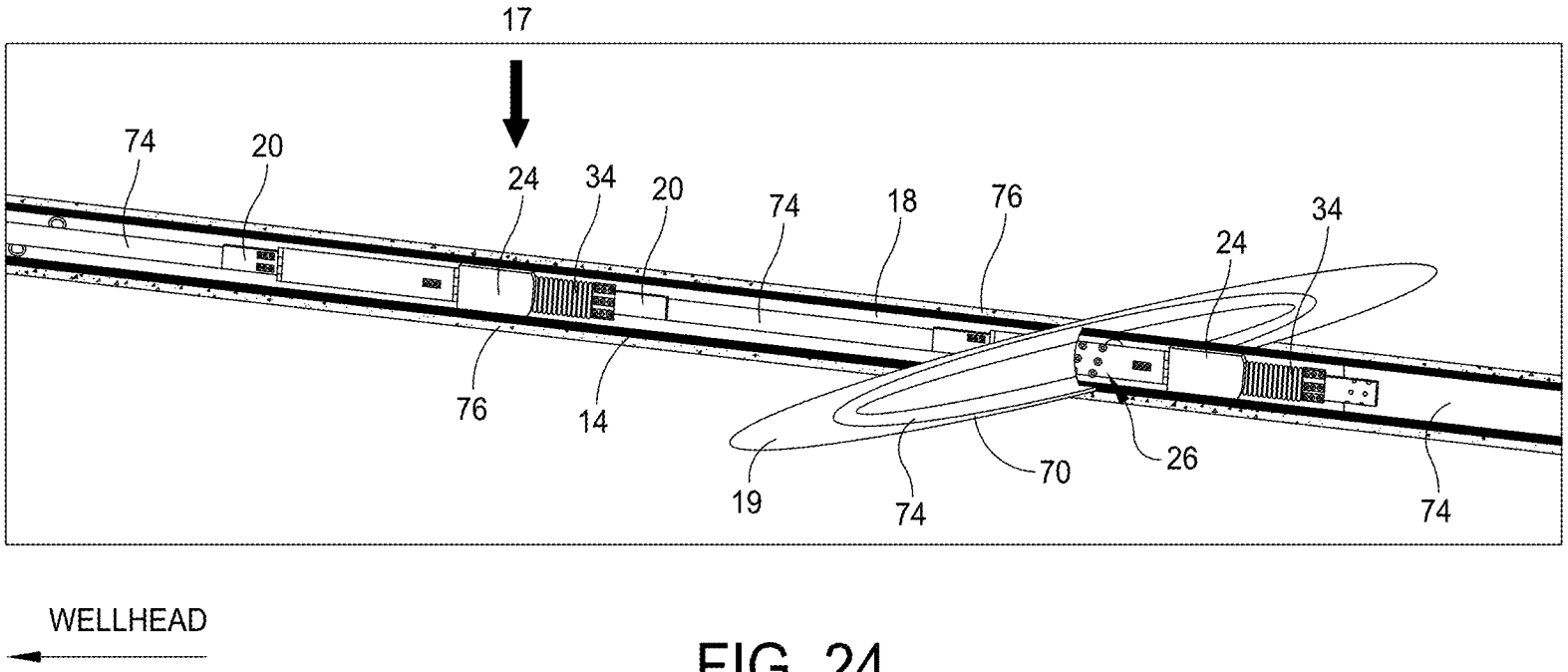
FIG. 24 illustrates opening the axial bypass valve after stimulating the new interval, in accordance with an embodiment of the present disclosure.
Figures 28A, 28B, 28C, 28D:
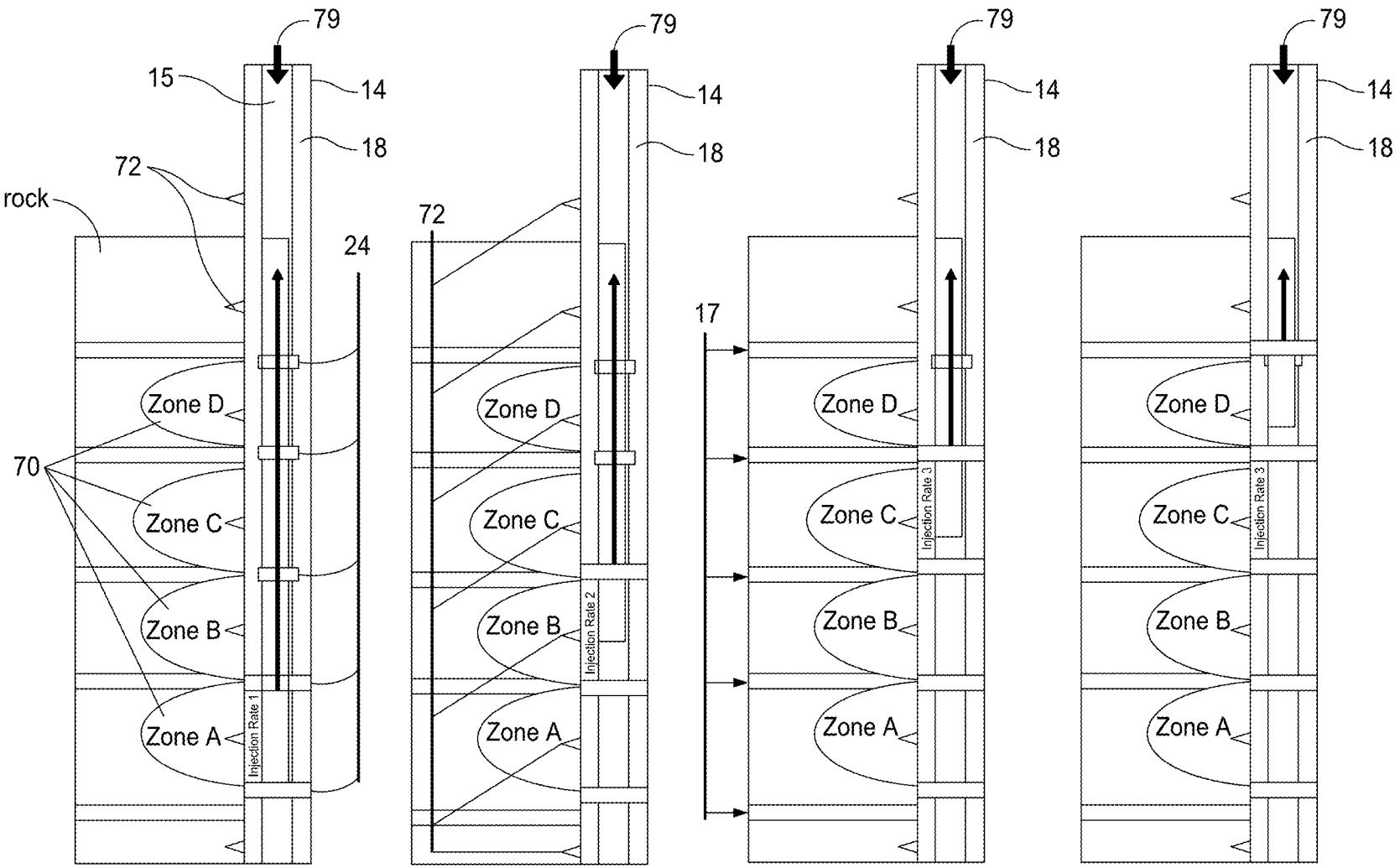
FIG. 28*a*-28*d* illustrate an isolating tool with 5 annular seals for stimulating 4 adjacent production intervals, in accordance with an embodiment of the present disclosure.

Referring to FIGS. 23-24 and 28, the 4-zone method (the $3^{rd}$ application) may further comprise lowering the configured tool into the well lateral and lining up the seals 24 with the demarcations 17 as shown in FIG. 28*a*. Tubular injection 79 may be initiated to a velocity between the first and the second seal threshold (for example, 125 GPM), thereby bracketing and stimulating zone A only and closing off the housing bottom end 23. After sufficient time has passed, tubular injection 79 may be increased by one increment in the seal threshold (e.g. by 50 GPM), and may thereby engage the $3^{rd}$ seal and begin to stimulate zone B.

At this point, some of the injected well fluids 19 may feed into zone A. However, zone A may be saturated and present significant resistance to further injection, which may preserve an adequate treatment of zone B. Should an increase in well pressure slow down the injection velocity, the tool 11 may naturally self-correct by lowering the velocity and opening the seals to let the system flush downstream. The method may conclude by continuing to stepwise escalate the injection velocity until all five seals 24 are engaged and all four zones have been stimulated or otherwise treated.

Figure 25:
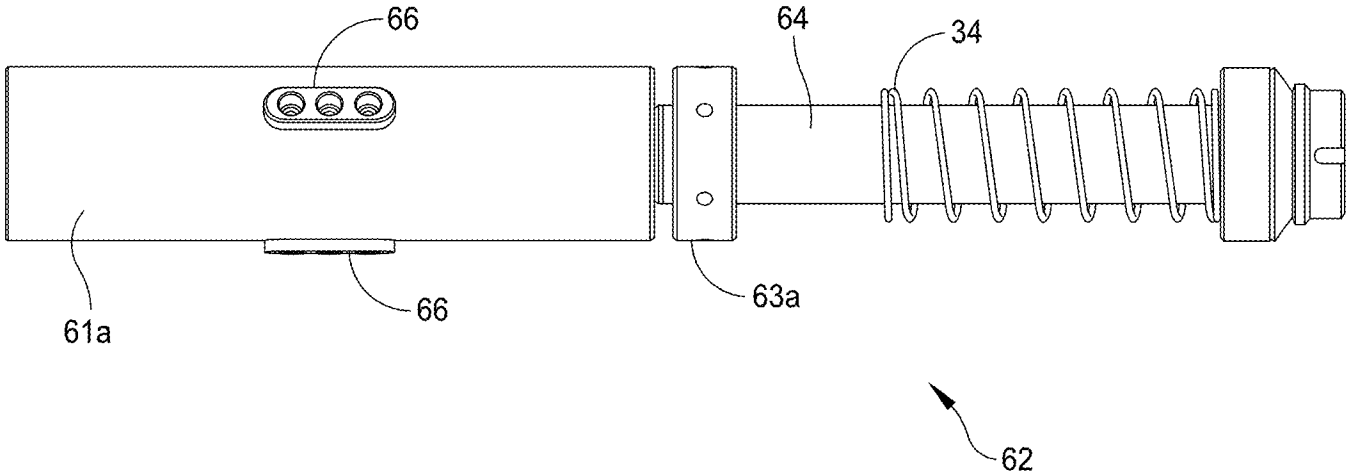
FIG. 25 illustrates a choke assembly for positioning the slidable element, in accordance with an embodiment of the present disclosure.
Figure 27:
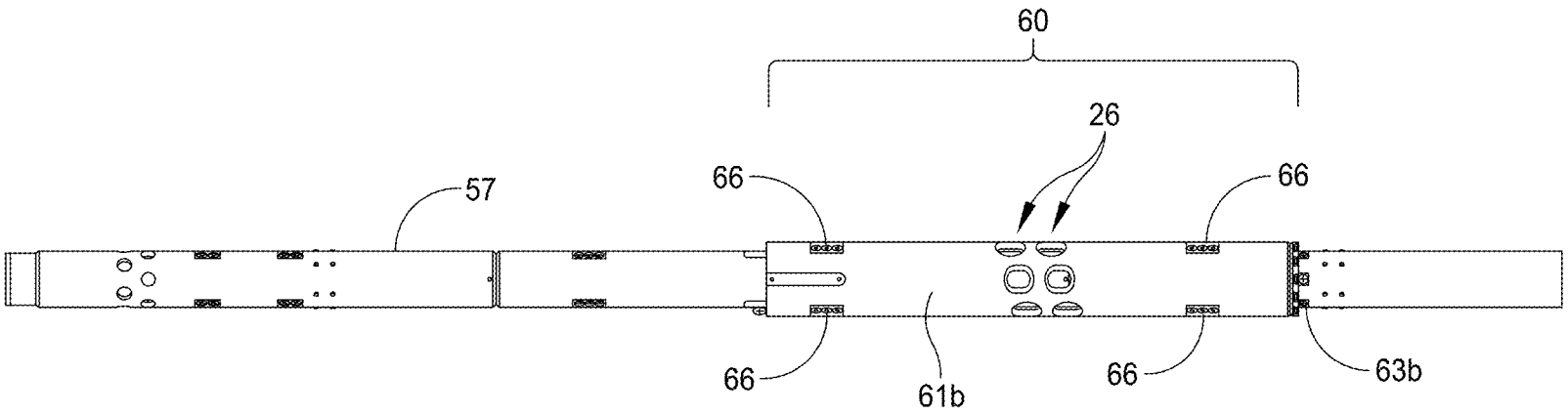
FIG. 27 illustrates the sliding assembly mounted to a tool body, in accordance with an embodiment of the present disclosure.

Referring now to FIGS. 25-27, in various embodiments, a sliding assembly 60 is described. The assembly (FIGS. 25-26) 60 may join a choke assembly 62, for establishing the positioning spring 24, to the slidable element 30 with an inner sleeve 61*a* in one continuous and sealed axial unit conveying the well fluids 19. An outer sleeve 61*b* (FIGS. 26-27) may sealingly wrap the inner sleeve 61*a*, element body 30, and choke assembly 62 components, and may slidingly translate compressive forces from the slidable element 30 to an outer casing 65 (FIG. 20*b*) of the tool 11 for expanding the flexure annular seal 24. The assembly 60 may be housed within a tool body 57 within which the assembly 60 slides (FIGS. 20*b* and 27).

Continuing, the sliding assembly may also include the axial bypass 40 near the housing bottom end. Keyways 66 may link the outer sleeve 61*b* to the sliding components of the sliding assembly 60. The choke assembly 62 may include a choke shaft 64 onto which the spring 34 slides. A choke mounting ring 63*a* may be configured to adjustably limit the spring compression and may be fastened to the tool body 57 (part of the housing 20) for positioning the spring.

Figure 10:
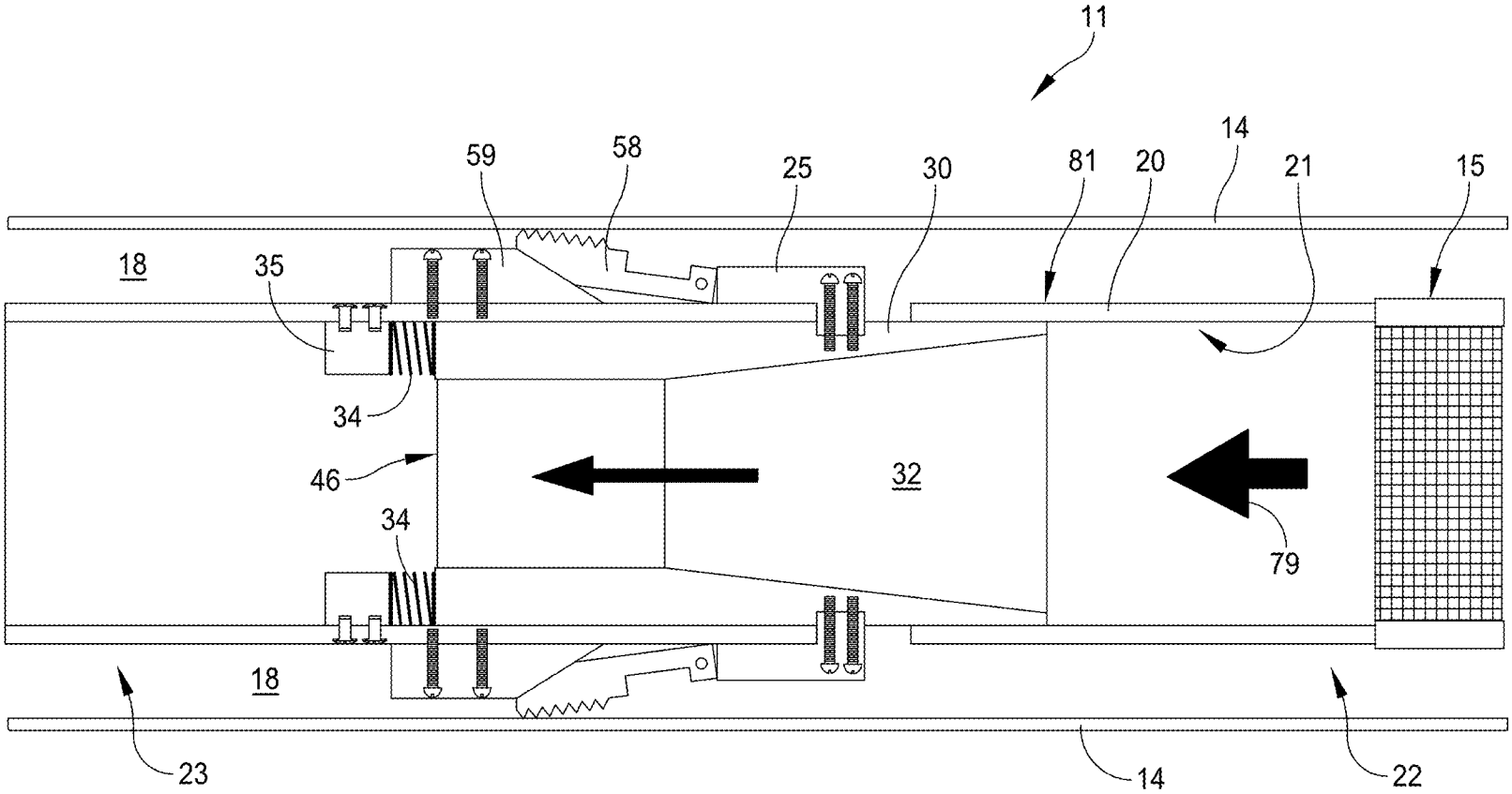
FIG. 10 illustrates a cutaway drawing of the slidable element with anchoring slips, in accordance with an embodiment of the present disclosure.

Referring now to FIG. 10, in an embodiment, the tool 11 may comprise one or more anchoring slips 58 disposed on the housing exterior wall 81 for locking the tool to the well bore 14 prior to executing the treatment of the production interval 16. An axially-sloping ramp 59 may be disposed on the housing 20 and an outward-facing jaw, comprising the slip 59, may be disposed next to the ramp and linked to an anchoring compression means 25 actuatable by sliding element 30 for sliding onto the ramp, pushing the jaw 58 toward the well bore 14.

Although the above embodiments have been described in language that is specific to certain structures, elements, compositions, and methodological steps, it is to be understood that the technology defined in the appended claims is not necessarily limited to the specific structures, elements, compositions and/or steps described. Rather, the specific aspects and steps are described as forms of implementing the claimed technology. Since many embodiments of the technology can be practiced without departing from the spirit and scope of the invention, the invention resides in the claims hereinafter appended.

What is claimed is:

1. An isolating tool for selectively orienting a flow of a well fluid with respect to a demarcation in an annulus of a well bore, the annulus defined by a production tubing inside the well bore, the tool attachable to a downhole end of the production tubing injecting or receiving the well fluid, the tool comprising:

a cylindrical tool housing having a top end conductively connectable to the production tubing and a bottom end opposite the top end;

a lower cylindrical element spring-positioned within and slidably sealing an exterior of the element against an interior wall of the tool housing, the element having an element bore narrowing toward one end and conductive of the well fluid from the production tubing, the spring-positioning and the narrowing bore configured to compress the element toward the narrowing end of the element in proportion to an injection velocity of the well fluid;

a lower expandable annular seal disposable on an exterior wall of the tool housing for restricting annular fluid flow across the demarcation;

a lower compression means linked to the slidable element for expanding the lower seal against the well bore when the injection velocity of the well fluid exceeds a lower seal threshold; and where exceeding the lower seal threshold enables a treatment of a hydrocarbon production interval surrounding the well bore above the demarcation;

an element upstream port connecting the bore to the element exterior above the seal, and an annular upstream passage in the housing, the port and the passage slidably alignable for annular upstream flow from the bore when the injection velocity exceeds an upstream flow threshold and the bottom end of the housing is closed.

2. The tool of claim 1, wherein:

the lower seal threshold is variable by one or more of a preloading of the positioning spring, a spring constant, a bore length, and a degree of bore narrowing.

3. The tool of claim 1, wherein:

the upstream flow threshold is variable by setting an axial distance between the port and the passage at a zero injection velocity.

4. The tool of claim 1, further comprising:

an elongation of the annular passage for varying the upstream threshold to occur over a range of injection velocities.

5. An isolating tool for selectively orienting a flow of a well fluid with respect to a demarcation in an annulus of a well bore, the annulus defined by a production tubing inside the well bore, the tool attachable to a downhole end of the production tubing injecting or receiving the well fluid, the tool comprising:

a cylindrical tool housing having a top end conductively connectable to the production tubing and a bottom end opposite the top end;

a lower cylindrical element spring-positioned within and slidably sealing an exterior of the element against an interior wall of the tool housing, the element having an element bore narrowing toward one end and conductive of the well fluid from the production tubing, the spring-positioning and the narrowing bore configured to compress the element toward the narrowing end of the element in proportion to an injection velocity of the well fluid;

a lower expandable annular seal disposable on an exterior wall of the tool housing for restricting annular fluid flow across the demarcation;

a lower compression means linked to the slidable element for expanding the lower seal against the well bore when the injection velocity of the well fluid exceeds a lower seal threshold; and where exceeding the lower seal threshold enables a treatment of a hydrocarbon production interval surrounding the well bore above the demarcation;

an element downstream port connecting the bore to the element exterior below the seal, and an annular downstream passage in the housing, the port and the passage slidably alignable for annular downstream flow from the bore when the injection velocity falls below a downstream flow threshold, thereby closing off the bottom end at higher velocities.

6. An isolating tool for selectively orienting a flow of a well fluid with respect to a demarcation in an annulus of a well bore, the annulus defined by a production tubing inside the well bore, the tool attachable to a downhole end of the production tubing injecting or receiving the well fluid, the tool comprising:

a cylindrical tool housing having a top end conductively connectable to the production tubing and a bottom end opposite the top end;

a lower cylindrical element spring-positioned within and slidably sealing an exterior of the element against an interior wall of the tool housing, the element having an element bore narrowing toward one end and conductive of the well fluid from the production tubing, the spring-positioning and the narrowing bore configured to compress the element toward the narrowing end of the element in proportion to an injection velocity of the well fluid;

a lower expandable annular seal disposable on an exterior wall of the tool housing for restricting annular fluid flow across the demarcation;

a lower compression means linked to the slidable element for expanding the lower seal against the well bore when the injection velocity of the well fluid exceeds a lower seal threshold; and where exceeding the lower seal threshold enables a treatment of a hydrocarbon production interval surrounding the well bore above the demarcation;

an upper slidable element spring-positioned within the tool housing and upstream of the lower slidable element, the element configured with a narrowing bore for compression toward its narrowing end in proportion to the injection velocity, an upper compression means linked to the upper element for expanding an upper annular seal against the well bore when the injection velocity exceeds an upper seal threshold, the lower and the upper slidable elements for isolating and pressurizing the production interval through a perforation cluster in the well bore;

an element upstream port connecting the bore of the lower slidable element to the element exterior above the lower seal, and an annular upstream passage in the housing, the upstream port and the upstream passage slidably alignable for an annular upstream flow from the bore when the injection velocity exceeds an upstream flow threshold, and an element downstream port connecting the bore of the lower slidable element to the element exterior below the lower seal, and an annular downstream passage in the housing, the downstream port and the downstream passage slidably alignable for an annular downstream flow from the bore when the injection velocity falls below a downstream flow threshold.

7. The tool of claim 6, wherein:

the tool is configured with the upper seal threshold set at a relatively low injection velocity, and also configured with the lower seal threshold, the upstream flow threshold, and the downstream flow threshold set at a relatively high velocity, thereby remotely directing a stimulation of the production interval when operating above the high velocity, and remotely directing a flushing through the tool when operating at intermediate velocities.

8. The tool of claim 6, wherein:

the tool is configured to set the upper and the lower seal thresholds at a relatively low injection velocity, and configured to set the upstream and the downstream flow thresholds at a relatively high velocity, thereby remotely directing a tubular injection of a middle production interval straddled by the two seals, an annular injection of an upper production interval above the upper seal, and a tubular injection of a lower production interval below the lower seal when operating at an intermediate injection velocity.

9. The tool of claim 6, wherein:

the lower annular seal is one of a bank of expandable elastic O-rings and a band of shaped rubber, where the lower compression means squeezes the sides of the seal axially.

10. An isolating tool for selectively orienting a flow of a well fluid with respect to two demarcations bracketing a fracture zone of a well bore, the tool attachable to a lower end of a production tubing injecting or receiving the well fluid, the production tubing inside the well bore defining an annulus, the tool comprising:

a cylindrical tool housing having a top end conductively connectable to the production tubing and a bottom end opposite the top end;

a lower and an upper cylindrical element slidingly positioned within and near opposite ends of the tool housing, where each of the elements:

is spring-positioned with an element exterior sealing against an interior wall of the tool housing, includes an element bore narrowing toward one end and conductive of the well fluid from the production tubing, and is configured to compress the element toward the narrowing end in proportion to an injection velocity of the well fluid by adjusting the spring positioning and bore dimensions;

a lower and an upper annular seal each disposable on an exterior wall of the tool housing at the lower and the upper demarcations, respectively, for restricting fluid flow across the annulus;

a lower and an upper compression means linked respectively to the lower and the upper slidable elements for expanding the lower seal against the well bore when the injection velocity exceeds a lower seal threshold and for expanding the upper seal against the well bore when the injection velocity exceeds an upper seal threshold;

where an injection velocity exceeding the upper and the lower seal thresholds seals the annulus at both demarcations for treating the fracture zone; and the upper and the lower annular seals each further comprise:

a conical collar disposable around the housing exterior at the respective well bore demarcation and axially sloping outward in a direction of seal compression;

a cylindrical flexure sleeve formed of multiple tines ringed at one end to receive pressure from the respective compression means during fluid injection, the multiple tines free floating at the other end for slidable expansion over the conical collar;

a rubber overmolding substantially wrapping the flexure sleeve and expandable at the respective demarcation when acted upon by the respective slidable element; and where an injection velocity exceeding the upper and the lower seal thresholds expands the rubber overmoldings to seal the annulus at both demarcations for treating the fracture zone.

11. The tool of claim 10, wherein:

the sloping surface of the conical collar is oriented to be widest near the bottom end of the housing for enabling an upward tug on the tubing string to release a stuck seal.

12. An isolating tool for selectively orienting a flow of a well fluid with respect to two demarcations bracketing a fracture zone of a well bore, the tool attachable to a lower end of a production tubing injecting or receiving the well fluid, the production tubing inside the well bore defining an annulus, the tool comprising:

a cylindrical tool housing having a top end conductively connectable to the production tubing and a bottom end opposite the top end;

a lower and an upper cylindrical element slidingly positioned within and near opposite ends of the tool housing, where each of the elements:

is spring-positioned with an element exterior sealing against an interior wall of the tool housing, includes an element bore narrowing toward one end and conductive of the well fluid from the production tubing, and is configured to compress the element toward the narrowing end in proportion to an injection velocity of the well fluid by adjusting the spring positioning and bore dimensions;

a lower and an upper annular seal each disposable on an exterior wall of the tool housing at the lower and the upper demarcations, respectively, for restricting fluid flow across the annulus;

a lower and an upper compression means linked respectively to the lower and the upper slidable elements for expanding the lower seal against the well bore when the injection velocity exceeds a lower seal threshold and for expanding the upper seal against the well bore when the injection velocity exceeds an upper seal threshold;

where an injection velocity exceeding the upper and the lower seal thresholds seals the annulus at both demarcations for treating the fracture zone; and the element bore of one of the upper and the lower slidable element narrows toward the top end of the housing for compressing the element in a direction opposite to that of the injection velocity.

13. An isolating tool for selectively orienting a flow of a well fluid with respect to two demarcations bracketing a fracture zone of a well bore, the tool attachable to a lower end of a production tubing injecting or receiving the well fluid, the production tubing inside the well bore defining an annulus, the tool comprising:

a cylindrical tool housing having a top end conductively connectable to the production tubing and a bottom end opposite the top end;

a lower and an upper cylindrical element slidingly positioned within and near opposite ends of the tool housing, where each of the elements:

is spring-positioned with an element exterior sealing against an interior wall of the tool housing, includes an element bore narrowing toward one end and conductive of the well fluid from the production tubing, and is configured to compress the element toward the narrowing end in proportion to an injection velocity of the well fluid by adjusting the spring positioning and bore dimensions;

a lower and an upper annular seal each disposable on an exterior wall of the tool housing at the lower and the upper demarcations, respectively, for restricting fluid flow across the annulus;

a lower and an upper compression means linked respectively to the lower and the upper slidable elements for expanding the lower seal against the well bore when the injection velocity exceeds a lower seal threshold and for expanding the upper seal against the well bore when the injection velocity exceeds an upper seal threshold;

where an injection velocity exceeding the upper and the lower seal thresholds seals the annulus at both demarcations for treating the fracture zone; and an axial bypass downstream of the lower annular seal for closing tubular outflow therefrom and for pressurizing the fracture zone, the axial bypass comprising a conical plug closing off the center of a bottom end of the lower slidable element, a drain gating a central portion of the bottom end of the tool housing and sealingly receivable of the conical plug when the injection velocity is greater than a bypass threshold, and one or more plug vents around the central portion for passing well fluids when the axial bypass is open.

14. An isolating tool for selectively orienting a flow of a well fluid with respect to two demarcations bracketing a fracture zone of a well bore, the tool attachable to a lower end of a production tubing injecting or receiving the well fluid, the production tubing inside the well bore defining an annulus, the tool comprising:

a cylindrical tool housing having a top end conductively connectable to the production tubing and a bottom end opposite the top end;

a lower and an upper cylindrical element slidingly positioned within and near opposite ends of the tool housing, where each of the elements:

is spring-positioned with an element exterior sealing against an interior wall of the tool housing, includes an element bore narrowing toward one end and conductive of the well fluid from the production tubing, and is configured to compress the element toward the narrowing end in proportion to an injection velocity of the well fluid by adjusting the spring positioning and bore dimensions;

a lower and an upper annular seal each disposable on an exterior wall of the tool housing at the lower and the upper demarcations, respectively, for restricting fluid flow across the annulus;

a lower and an upper compression means linked respectively to the lower and the upper slidable elements for expanding the lower seal against the well bore when the injection velocity exceeds a lower seal threshold and for expanding the upper seal against the well bore when the injection velocity exceeds an upper seal threshold;

where an injection velocity exceeding the upper and the lower seal thresholds seals the annulus at both demarcations for treating the fracture zone; and an element upstream port connecting the bore of the lower slidable element to the element exterior above the lower seal, and an annular upstream passage in the housing, the upstream port and the upstream passage slidably alignable for an annular upstream flow from the bore when the injection velocity exceeds an upstream flow threshold and the bottom end of the housing is closed.

15. A method for treating an isolated hydrocarbon interval of a well bore feedable by a well fluid through a production tubing inside the well bore, the well bore and the production tubing forming an annulus therebetween, the method comprising:

attaching to the production tubing a perforated cylindrical housing disposed with an expandable annular seal and an internal element slidable within the housing, the slidable element mechanically linked to actuate the annular seal and positionally responsive to an injection velocity of the well fluid and positioned by a spring;

lowering the cylindrical housing to a sealing depth for bracketing a perforation cluster in the well bore for the corresponding hydrocarbon interval;

injecting the well fluid and selecting an injection velocity sufficient to drag the slidable element downward for expanding the annular seal against the well bore, the drag induced by an element bore conically narrowing toward a lower end of the element; and directing an annular flow downstream or upstream of the expandable seal by either setting a downstream injection velocity to slidably align an element downstream port with a corresponding housing perforation, or setting an upstream injection velocity exclusively different from the downstream injection velocity in order to slidably align an element upstream port with a corresponding housing perforation.

16. The method of claim 15, further comprising:

setting a minimum sealing velocity for expanding the annular seal by adjusting one or more of a preloading of the positioning spring, a spring constant, an element bore length, and a degree of bore narrowing; and setting the minimum upstream flow threshold and the maximum downstream flow threshold by adjusting, at a zero velocity, an axial distance between the corresponding element port and its complementary housing perforation.

17. The method of claim 16, further comprising:

disposing on the housing a second annular seal mechanically linked to a second slidable element within the housing, both of the seals and their respective elements spaced for bracketing the hydrocarbon interval;

setting the minimum sealing threshold for the upper of the two annular seals at a relatively low velocity, setting the minimum sealing threshold for the lower of the two annular seals at a relatively high velocity, and adjusting the axial distance between the upstream and the downstream ports such that the annular downstream flow ceases and the annular upstream flow ensues when exceeding the relatively high velocity;

injecting the well fluids at the high velocity to stimulate the hydrocarbon interval; and reducing the injection velocity to an intermediate velocity for flushing the well fluids down the annulus and out a bottom end of the housing.

* * * * *